US010777171B1

(12) United States Patent
Tiene et al.

(10) Patent No.: US 10,777,171 B1
(45) Date of Patent: Sep. 15, 2020

(54) ELECTRIC MUSICAL INSTRUMENT HAVING A BRIDGE

(71) Applicant: Bose Corporation, Framingham, MA (US)

(72) Inventors: Michael Tiene, Franklin, MA (US); Roman N. Litovsky, Newton, MA (US); Mikhail Ioffe, Newton, MA (US); Chester Smith Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/683,838

(22) Filed: Nov. 14, 2019

(51) Int. Cl.
*G10D 1/08* (2006.01)
*G10H 3/18* (2006.01)

(52) U.S. Cl.
CPC ..... *G10D 1/085* (2013.01); *G10H 3/181* (2013.01); *G10H 3/182* (2013.01); *G10H 3/185* (2013.01)

(58) Field of Classification Search
CPC ..... G10D 1/085; G10H 3/181; G10H 3/182; G10H 3/185
See application file for complete search history.

(56) References Cited

U.S. PATENT DOCUMENTS

| | | | | |
|---|---|---|---|---|
| 5,339,718 | A * | 8/1994 | Leduc | G10D 1/085 84/275 |
| 5,539,147 | A * | 7/1996 | Hoshino | G10H 3/185 84/723 |
| 6,166,309 | A * | 12/2000 | Hoshino | G10D 3/04 84/298 |
| 10,636,403 | B2 * | 4/2020 | Clark | G10H 3/143 |
| 10,643,587 | B1 * | 5/2020 | McCormick | G10D 3/10 |
| 2010/0307324 | A1 * | 12/2010 | Takabayashi | G10H 3/185 84/731 |

* cited by examiner

*Primary Examiner* — Robert W Horn
(74) *Attorney, Agent, or Firm* — Fish & Richardson P.C.

(57) ABSTRACT

An electric musical instrument includes a body and a resonant stack. The resonant stack includes a bridge having a bridge mass and at least a first spring having a first spring constant, in which the first spring is positioned between the bridge and the body. The resonant stack has at least one resonant frequency that is dependent on the bridge mass and the first spring constant. The electric musical instrument includes a plurality of strings that extend across at least a portion of the body, in which each string has a vibrating length defined at least in part by the bridge. The electric musical instrument includes at least a first pickup device to detect vibrations of the strings and generate a first pickup signal, and at least a second pickup device to detect movements of the bridge and generate a second pickup signal.

25 Claims, 28 Drawing Sheets

0.03 mm/N • 100N = 3.0mm

ELECTRIC MUSICAL INSTRUMENT HAVING A BRIDGE

TECHNICAL FIELD

The description relates to an electric musical instrument having a bridge.

BACKGROUND

In some examples, an electric guitar includes a body, strings, and one or more pickups for detecting vibrations of the strings. A bridge supports the strings over the body under tension. For example, a magnetic pickup can be used in which the pickup includes magnets wrapped with coils of wire that react to disturbances caused by the guitar's vibrating metal strings. A pickup designed for a multi-string guitar can have multiple poles, each pole corresponding to the string positioned above it. Plucking a string causes the pickup to produce an electronic signal that corresponds to the string's vibrations. The electric guitar may include an output jack for connecting a guitar cable to an external power amplifier, which in turn drives a speaker. The power amplifier may be connected to an equalizer or other equipment for producing desired sound effects. The electric guitar may include an audio jack for connecting to a headphone.

SUMMARY

This document describes an electric string instrument that includes a stack of mass-spring resonators positioned under the bridge so that the resonators are excited when the instrument is played. By mounting the bridge on the resonators, the instrument has a softer feel when played as compared to a traditional electric string instrument in which the bridge is rigidly mounted to the body of the instrument. The mass-spring resonators produce resonances in a range from 40 to 450 Hz to emulate the sound and feel of an acoustic string instrument. For example, the electric string instrument can be an electric guitar, an electric bass guitar, an electric violin, an electric viola, an electric cello, an electric double bass, an electric banjo, an electric mandolin, or an electric ukulele.

In a general aspect, an electric musical instrument includes a body and a resonant stack. The resonant stack includes a bridge having a bridge mass and at least a first spring having a first spring constant, in which the first spring is disposed between the bridge and the body. The resonant stack has at least one resonant frequency that is dependent on the bridge mass and the first spring constant. The electric musical instrument includes a plurality of strings that extend across at least a portion of the body, in which each string has a vibrating length defined at least in part by the bridge. The electric musical instrument includes at least a first pickup device to detect vibrations of the strings and generate a first pickup signal; and at least a second pickup device to detect movements of the bridge and generate a second pickup signal.

Implementations of the electric musical instrument can include one or more of the following features. The resonant stack can include the bridge, the first spring, a second mass, and a second spring having a second spring constant. The bridge, the first spring, the second mass, and the second spring can be configured such that vibrations at the bridge are transmitted to the second mass through the first spring, and vibrations at the second mass are transmitted to the second spring. The resonant stack can have at least two resonant frequencies that are dependent on the bridge mass, the first spring constant, the second mass, and the second spring constant.

The resonant stack can include a second mass and a second spring having a second spring constant. The first spring can be disposed between the bridge and the second mass, and the second spring can be disposed between the second mass and the body. The resonant stack can have at least a first resonant frequency and a second resonant frequency that are dependent on the bridge mass, the second mass, the first spring constant, and the second spring constant.

The resonant stack can include the bridge, the first spring, the second mass, the second spring, a third mass, and a third spring having a third spring constant. The bridge, the first spring, the second mass, the second spring, the third mass, and the third spring can be configured such that vibrations at the second mass are transmitted to the third mass through the second spring, and vibrations at the third mass are transmitted to the third spring. The resonant stack can have at least three resonant frequencies that are dependent on the bridge mass, the first spring constant, the second mass, the second spring constant, the third mass, and the third spring constant.

The resonant stack can include a third mass and a third spring having a third spring constant. The first spring can be disposed between the bridge and the second mass, the second spring can be disposed between the second mass and the third mass, and the third spring can be disposed between the third mass and the body. The resonant stack can have at least a first resonant frequency, a second resonant frequency, and a third resonant frequency that are dependent on the bridge mass, the second mass, the third mass, the first spring constant, the second spring constant, and the third spring constant.

The electric musical instrument can include a locking mechanism having a first operational state and a second operational state. In the first operational state the locking mechanism can be configured to lock the bridge to suppress oscillations of the bridge, and in the second operational state the locking mechanism does not suppress the oscillations of the bridge.

The electric musical instrument can include a fingerboard; a nut; and a plurality of strings extending from the nut to the bridge across at least a portion of the fingerboard and at least a portion of the body. A first portion of the bridge can be pivotly coupled to the body, or pivotly coupled to a hinge coupled to the body. A second portion of the bridge can be coupled to the first spring. The nut and saddles coupled to the second portion of the bridge plate can define the vibrating lengths of the strings.

In another general aspect, an electric musical instrument includes a body, a fingerboard, a nut, and a resonant bridge module. The resonant bridge module includes a bridge plate, a first spring, a second mass, and a second spring. The bridge plate has a bridge plate mass, the first spring has a first spring constant, and the second spring has a second spring constant. The resonant bridge module has at least a first resonant frequency and a second resonant frequency that are dependent on the bridge plate mass, the first spring constant, the second mass, and the second spring constant. A plurality of strings extend from the nut to the bridge plate across at least a portion of the fingerboard and at least a portion of the body, in which the nut and the bridge define vibrating lengths of the strings. At least a first pickup device detects vibrations of the strings and generates a first pickup signal, and at least a second pickup device detects movements of the bridge and generates a second pickup signal.

Implementations of the electric musical instrument can include one or more of the following features. The electric musical instrument can include a locking mechanism having a first operational state and a second operational state, in which in the first operational state the locking mechanism can be configured to lock the resonant bridge module to suppress oscillations of the bridge plate, and in the second operational state the locking mechanism can be configured so that it does not suppress the oscillations of the bridge plate.

The locking mechanism can include a lever and at least one pin. The bridge plate can define at least one hole, and the lever can be configured to be movable between a first position and a second position. The locking mechanism can be configured such that moving the lever to the first position causes the at least one pin to engage the at least one hole to prevent oscillations of the bridge plate, and moving the lever to the second position causes the at least one pin to disengage from the at least one hole to allow the bridge plate to oscillate when excited by vibrations of the strings.

The locking mechanism can include a window style locking mechanism having a lock wheel having a finger, and the bridge plate can include a slot. The lock wheel can be rotatable between a first position and a second position, and configured such that when the lock wheel rotates to the first position, the finger of the lock wheel engages the slot of the bridge plate and prevents oscillations of the bridge plate, and when the lock wheel rotates to the second position, the finger of the lock wheel disengages from the slot of the bridge plate to enable the bridge plate to oscillate when excited by vibrations of the strings.

A center of mass of the first spring can be disposed between a center of mass of the bridge plate and a center of mass of the second mass, and a center of mass of the second spring can be disposed between a center of mass of the second mass and the body of the electrical musical instrument.

The bridge plate can be directly or indirectly coupled to the second mass through the first spring, and the second mass can be directly or indirectly coupled to the body through the second spring.

The bridge plate, the first spring, and the second mass can be configured such that when the bridge plate vibrates, at least a portion of the vibration of the bridge plate is transmitted to the second mass through the first spring.

The electric musical instrument can include an electronic circuit configured to combine the first pickup signal with the second pickup signal to generate a combined output signal.

The electric musical instrument can include an electronic circuit to process at least one of the first pickup signal or the second pickup signal. The instrument can include a switch that is configured to select between a first mode and a second mode. When the first mode is selected, the electronic circuit can be configured to combine the first pickup signal and the second pickup signal to generate a combined output signal that is provided to an output jack of the electric musical instrument. When the second mode is selected, the electronic circuit can be configured to provide the first pickup signal to the output jack.

The first pickup signal can be configured to have sound characteristics that resemble those of a conventional electric guitar, and the mixed output signal can be configured to have sound characteristics that more closely resemble those of a conventional acoustic guitar.

The first and second resonant frequencies can correspond to resonant frequencies of the acoustic guitar defined by at least one of top and bottom decks of the acoustic guitar, an acoustic volume of the acoustic guitar, or a sound hole dimension of the acoustic guitar.

In some examples, the first and second resonant frequencies can be in a range between 40 Hz to 450 Hz.

In some examples, the electric musical instrument can be an electronic guitar, and the first and second resonant frequencies can both be in a range between 80 Hz to 300 Hz.

In some examples, the electric musical instrument can be an electronic bass guitar, and the first and second resonant frequencies can both be in a range between 40 Hz to 300 Hz.

The first and second resonant frequencies can be configured to substantially match natural resonant frequencies of a specific acoustic guitar, or a specific type of acoustic guitars.

A first portion of the bridge plate can be pivotly coupled to the body, or pivotly coupled to a hinge coupled to the body, and a second portion of the bridge plate can be coupled to the first spring. The nut and saddles coupled to the second portion of the bridge plate can define the vibrating lengths of the strings.

The resonant bridge module can further include a third mass and a third spring that has a third spring constant. The resonant bridge module can have at least a first resonant frequency, a second resonant frequency, and a third resonant frequency that are dependent on the bridge plate mass, the first spring constant, the second mass, the second spring constant, the third mass, and the third spring constant.

A center of mass of the third spring can be disposed between a center of mass of the second mass and a center of mass of the third mass, and a center of mass of the second spring can be disposed between a center of mass of the third mass and the body.

The bridge plate can be directly or indirectly coupled to the second mass through the first spring, the second mass can be directly or indirectly coupled to the third mass through the third spring, and the third mass can be directly or indirectly coupled to the body through the second spring.

The bridge plate, the first spring, the second mass, the third spring, and the third mass can be configured such that when the bridge plate vibrates, at least a portion of the vibration of the bridge plate is transmitted to the second mass through the first spring, and when the second mass vibrates, at least a portion of the vibration of the second mass is transmitted to the third mass through the third spring.

The second mass can be configured to clamp the first spring to the second spring, and the third mass can be configured to clamp the second spring to the third spring.

In some examples, the first mass can be smaller than the second mass. In some examples, the first mass can be equal to the second mass.

Each of the first mass and the second mass can be in a range between 20 grams to 300 grams.

Each of the second mass and the third mass can be made of steel, brass, copper, plastic, glass, and/or a composite material.

In some examples, the first spring constant can be larger than the third spring constant. In some examples, the third spring constant can be larger than the second spring constant. In some examples, the first spring constant, the third spring constant, and the second spring constant can be the same.

Each of the first spring constant, the second spring constant, and the third spring constant can be in a range between 20,000 N/m to 100,000 N/m.

The resonant bridge module can be coupled to an upper surface of the body. The first spring, the second mass, and the third spring can be configured such that the second mass primarily oscillates along directions substantially orthogonal to the upper surface of the body.

The third spring, the third mass, and the second spring can be configured such that the third mass primarily oscillates along directions substantially orthogonal to the upper surface of the body.

The bridge plate, the first spring, the second mass, the third spring, the third mass, and the second spring can be configured such that each of the bridge plate, the second mass, and the third mass has a single degree of freedom.

The resonant bridge module can include a first damping material applied to the first spring and/or the second spring.

The first damping material can be configured to reduce a higher order resonance of the resonant bridge module.

The first spring can include a leaf-style spring having a first leaf member and a second leaf member. A first end of the first leaf member can be attached to a first end of the second leaf member, a second end of the first leaf member can be attached to a second end of the second leaf member, and a middle portion of the first leaf member can be spaced apart from a middle portion of the second leaf member to form an opening between the first and second leaf members.

The bridge plate can include a portion that clamps the first leaf member, and the second mass can include a portion that clamps the second leaf member. At least a first portion of the first leaf member can be movable relative to at least a first portion of the second leaf member to enable the bridge to move relative to the second mass.

The bridge plate or a clamp member coupled to the bridge plate can have a first portion that passes through the opening between the first and second leaf members. The second mass or a clamp member coupled to the second mass can have a first portion that passes through the opening between the first and second leaf members.

The second spring can include a leaf-style spring having a first leaf member and a second leaf member. The second mass can include a first portion and a second portion. The second mass can be configured to clamp the second leaf member of the first spring and the first leaf member of the second spring together. The first portion of the second mass can be configured to press against a middle portion of the second leaf member of the first spring in a first direction, and the second portion of the second mass can be configured to press against a middle portion of the first leaf member of the second spring in a second direction opposite to the first direction.

Each of the first and second leaf members can include a flexible rectangular metal member.

The second mass can be configured to clamp the first spring to the second spring.

In some examples, the first spring can include a compression spring having a coil member. In some examples, the first spring can include a metal machined helical spring. In some examples, the first spring can include a metal wave style spring having flexible wave-shape members, portions of the flexible wave-shape members can be attached to each other, openings can be formed between the flexible wave-shape members, and the metal wave style spring can be configured to be compressible by reducing the sizes of the openings between the flexible wave-shape members.

In some examples, the first spring can include an elastomer spring. In some examples, the first spring can include an air spring having an elastic bladder that holds an amount of air sealed inside the elastic bladder.

The second spring can be attached to an adjustment plate, and the adjustment plate can be coupled to the musical instrument body through an adjustment mechanism that enables adjustment of a distance between the adjustment plate and the musical instrument body. A change in the distance between the adjustment plate and the musical instrument body can result in a change in a distance between the bridge plate and the musical instrument body.

The adjustment mechanism can include at least one screw, and the adjustment mechanism can be configured such that the distance between the adjustment plate and the musical instrument body can be modified by turning the at least one screw.

The second pickup device can include a magnetic sensor and/or an optical sensor.

The electric musical instrument can include a digital signal processor configured to process at least one of the first pickup signal or the second pickup signal by applying a selected frequency response curve to the pickup signal, in which the selected frequency response is selected from a plurality of pre-stored frequency response curves.

Each of the plurality of frequency response curves can be configured to enable the digital signal processor to modify the pickup signal to mimic a particular guitar or a particular group of guitars.

The electric musical instrument can include a storage device configured to store data representing the frequency response curves, and a communication module configured to communicate with a computing device to enable downloading the data representing the frequency response curves from the computing device.

The electric musical instrument can include an electric guitar, an electric bass guitar, an electric violin, an electric viola, an electric cello, an electric double bass, an electric banjo, an electric mandolin, or an electric ukulele.

At least one of the first spring or the second spring can have an adjustable spring constant.

The resonant frequency can be modified by adjusting the spring constant.

At least one of the first spring or the second spring can include an air cylinder in which the pressure in the air cylinder is adjustable to vary the spring constant.

At least one of the first spring or the second spring can include an air cylinder in which the volume of the air cylinder is adjustable to vary the spring constant.

The electric musical instrument can include a controller configured to control the adjustable spring constant to adjust at least one of the first resonant frequency or the second resonant frequency.

The electric musical instrument can include one or more weights that are magnetically coupled to at least one of the bridge plate or the second mass to adjust at least one of the first resonant frequency or the second resonant frequency.

In some examples, the resonant bridge module can be configured to cover less than 30 square inches of a surface area of the body. In some examples, the resonant bridge module can be configured to cover less than 10 square inches of a surface area of the body.

The electric musical instrument can be configured to output a specified maximum unamplified audio level when the strings are strummed, and the resonant bridge module can be configured to produce no sound or a sound that is negligible to the player without electric amplification when the electric musical instrument outputs the specified maximum unamplified audio level. In another general aspect, an electric musical instrument includes: a body and a floating bridge. The floating bridge has a first portion pivotly coupled to the body or pivotly coupled to a hinge attached to the body, in which the floating bridge has a second section resonantly coupled to the body through at least a first spring.

The floating bridge is configured to have at least a first natural resonant frequency in a range from 40 Hz to 450 Hz. The electric musical instrument includes a plurality of strings that extend across at least a portion of the body, in which each string has a vibrating length defined at least in part by the floating bridge; and a first pickup device configured to detect movements of the bridge and generate a first pickup signal.

Implementations of the electric musical instrument can include one or more of the following features. The first spring can include a leaf-style spring having a first leaf member and a second leaf member. A first end of the first leaf member can be attached to a first end of the second leaf member, a second end of the first leaf member can be attached to a second end of the second leaf member, and a middle portion of the first leaf member can be spaced apart from a middle portion of the second leaf member to form an opening between the first and second leaf members.

In another general aspect, an electric musical instrument includes: a body and a resonant bridge module that includes a bridge and at least a first spring. The bridge and the at least a first spring are configured to enable the bridge to oscillate at at least a first resonant frequency in a range from 40 Hz to 450 Hz. The electric musical instrument includes a plurality of strings that extend across at least a portion of the body, in which each string has a vibrating length defined at least in part by the bridge, and the resonant bridge module is configured to enable the bridge to oscillate upon being excited by vibrations of one or more of the strings. The electric musical instrument includes at least a first pickup device configured to detect vibrations of the strings and generate a first pickup signal; at least a second pickup device configured to detect movements of the bridge and generate a second pickup signal; and an electronic circuit configured to combine the first pickup signal and the second pickup signal to generate a combined signal that is provided to an output jack of the electric musical instrument.

Implementations of the electric musical instrument can include the following feature. The resonant bridge module can be configured such that the bridge has a single degree of freedom.

In another general aspect, a resonant bridge module for use in an electric musical instrument includes a bridge, at least a first spring, and a base plate. The base plate is configured to be attached to a body of the electric musical instrument. The bridge has a bridge mass, the first spring has a first spring constant, and the bridge mass and the first spring constant are selected such that the resonant bridge module has at least a first resonant frequency in a range from 40 Hz to 450 Hz. The bridge includes components for receiving a plurality of strings that extend across at least a portion of a body of the electric musical instrument, in which each string has a vibrating length defined at least in part by the bridge.

Implementations of the resonant bridge module can include one or more of the following features. The resonant bridge module can include a locking mechanism having a first state and a second state, in which in the first state the locking mechanism is configured to lock the resonant bridge module to suppress oscillations of the bridge, and in the second state the lock mechanism does not suppress the oscillations of the bridge.

A center of mass of the first spring can be disposed between a center of mass of the bridge and the plate.

The bridge can be directly or indirectly coupled to the body through the first spring.

The bridge and the first spring can be configured such that when the bridge vibrates, at least a portion of the vibration of the bridge is transmitted to the first spring.

The resonant bridge module can include a magnet attached to the bridge at a position that is configured to enable a first pickup device of the electric musical instrument to detect movements of the bridge by detecting movements of the magnet.

The resonant bridge module can include a second mass and a second spring that has a second spring constant. The resonant bridge module can have at least a first resonant frequency and a second resonant frequency that are dependent on the bridge mass, the first spring constant, the first mass, and the second spring constant.

A center of mass of the first spring can be disposed between a center of mass of the bridge and a center of mass of the second mass, and a center of mass of the second spring can be disposed between a center of mass of the second mass and the body.

The bridge can be directly or indirectly coupled to the second mass through the first spring, and the second mass can be directly or indirectly coupled to the body through the second spring.

The bridge and the first spring can be configured such that when the bridge vibrates, at least a portion of the vibration of the bridge is transmitted to the second mass through the first spring.

The resonant bridge module can include a third mass and a third spring that has a third spring constant. The resonant bridge module can have at least a first resonant frequency, a second resonant frequency, and a third resonant frequency that are dependent on the bridge mass, the first spring constant, the first mass, the third spring constant, the second mass, and the second spring constant.

A center of mass of the third spring can be disposed between a center of mass of the second mass and a center of mass of the third mass, and a center of mass of the second spring can be disposed between a center of mass of the third mass and the body.

The bridge can be directly or indirectly coupled to the second mass through the first spring, the second mass can be directly or indirectly coupled to the third mass through the third spring, and the third mass can be directly or indirectly coupled to the body through the second spring.

The bridge, the first spring, the second mass, the third spring, and the third mass can be configured such that when the bridge vibrates, at least a portion of the vibration of the bridge is transmitted to the second mass through the first spring. When the second mass vibrates, at least a portion of the vibration of the second mass can be transmitted to the third mass through the third spring.

The resonant bridge module can include a hinge, in which a first portion of the bridge can be pivotly coupled to a first portion of the hinge, a second portion of the hinge can be configured to be coupled to the body of the electric musical instrument, and a second portion of the bridge can be coupled to the first spring.

The electric musical instrument can include at least one of an electric guitar, an electric bass guitar, an electric violin, an electric viola, an electric cello, an electric double bass, an electric banjo, an electric mandolin, or an electric ukulele.

The aspects described above can be embodied as systems, methods, computer programs stored on one or more computer storage devices, each configured to perform the actions of the methods, or means for implementing the methods. A system of one or more computing devices can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

In some examples, the invention can have one or more of the following advantages. The modified electric musical instrument (e.g., electric guitar) having a resonant bridge imitates the sound and "feel" of an acoustic musical instrument (e.g., acoustic guitar) in a smaller and more compact musical instrument body. The electric musical instrument (e.g., electric guitar) preserves the tonal quality, physical "feel," and string playback perception of the acoustic musical instrument (e.g., acoustic guitar) and eliminates the acoustic feedback when amplified and played on-stage.

Unless otherwise defined, all technical and scientific terms used herein have the same meaning as commonly understood by one of ordinary skill in the art to which this invention belongs. In case of conflict with patents or patent applications incorporated herein by reference, the present specification, including definitions, will control.

Other features and advantages of the description will become apparent from the following description, and from the claims.

DETAILED DESCRIPTION

In this document we describe a novel electric string instrument, such as an electric guitar, having a resonant bridge that has masses and springs that are designed such that the resonant bridge has resonant frequencies that substantially match the resonant frequencies of a corresponding acoustic string instrument, such as an acoustic guitar. This allows the electric string instrument to sound and feel more similar to an acoustic string instrument, as compared to an electric string instrument that uses a conventional bridge that is rigidly mounted to the body of the instrument. In some implementations, the electric string instrument can be selectively operated in a first mode or a second mode, in which in the first mode the electric string instrument sounds and feels similar to a conventional electric string instrument, and in the second mode the electric string instrument sounds and feels similar to an acoustic string instrument.

In some examples, acoustic guitars are large and relatively quiet. When electrically amplified, some of the tonal qualities of the acoustic body are lost. In some examples, electric guitars are smaller, have no acoustic feedback problem on-stage, and allow freedom with electric amplification. However, electric guitars have a different, stiffer "feel" than acoustic guitars due to different electric and mechanical parameters that make their sound sustain, sympathetic string vibrations, and spectrum to be quite different from acoustic guitars. Some of these differences are related to the hard mounting of the bridge in electric guitars, which prevents strong cross coupling of the strings and precludes any bridge motion. In some examples, the acoustic guitar sound can be imitated by digitally modifying the sound of electric guitars. However, even with good simulation software, electric guitars may still feel and sound different from the acoustic guitars. The resonant bridge system described in this document provides a solution to this problem.

In the following, we describe an electric guitar having a resonant bridge system (also referred to as "resonant bridge," "flying bridge," or "flying resonant bridge") that has natural resonances that are similar to those of an acoustic guitar. The invention can also be applied to other types of electric string instruments, such as an electric bass guitar, an electric banjo, an electric mandolin, an electric ukulele, an electric violin, an electric viola, an electric cello, or an electric double bass.

Figure 1:
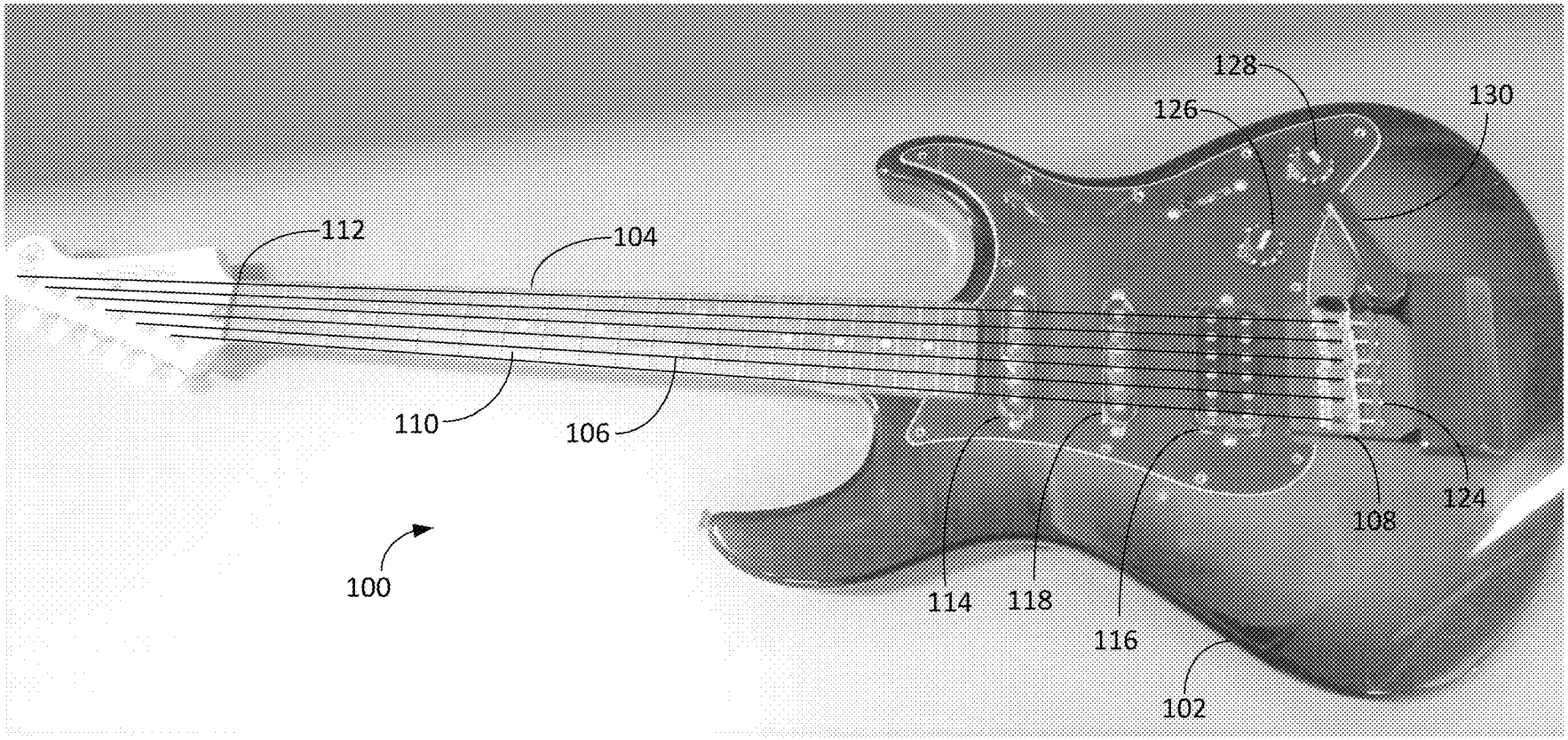
FIG. 1 is a diagram of an example electric guitar.

Referring to FIG. 1, an example electric guitar 100 includes a body 102, a neck 104, and strings 106 that extend across the neck 104 and the body 102 and terminate at a resonant bridge 108. The neck 104 includes a fretboard (or fingerboard) 110 that includes several frets. A nut 112 is positioned at the end of the fretboard 110, in which the nut 112 and the resonant bridge 108 define the vibrating lengths of the strings 106. One or more pickups are used to detect vibrations of the strings 106. In this example, a first pickup 114 (referred to as the neck pickup) is positioned under the strings 106 near the neck 104, a second pickup 116 (referred to as the bridge pickup) is positioned under the strings 106 near the resonant bridge 108, and a third pickup 118 (referred to as the middle pickup) is positioned between the neck pickup 114 and the bridge pickup 116.

For example, the neck pickup 114 and the middle pickup 118 can be single coil pickups, and the bridge pickup 116 can be a magnetic pickup such as a Humbucker pickup. In some examples, one or more piezoelectric pickups can also be used. The pickups 114, 116, and 118 detect vibrations of the strings 106 and in the following will collectively be referred to as "string pickups." In addition, the guitar 100 includes a bridge plate pickup 120 (FIG. 2) placed under a bridge plate 122 (which is part of the resonant bridge 108) for detecting vibrations of the bridge plate 122. The bridge plate pickup 120 can include, e.g., an optical sensor that detects light emitted from a light emitter attached to the underside of the bridge plate 122, or a magnetic coil sensor that detects magnetic field generated by a magnet attached to the underside of the bridge plate 122.

A tuning mechanism 124 is provided for tuning the tension of the strings 106. A volume control knob 126 is provided for controlling the sound volume, and a tone control knob 128 is provided for controlling the tone of the guitar sound. A lock lever 130 is provided to lock or unlock the resonant bridge 108. When the resonant bridge 108 is in the locked position, the resonant bridge 108 is prevented from moving in the vertical direction. When the resonant bridge 108 is in the unlocked position, the resonant bridge 108 can have vertical movements and oscillate at certain frequencies determined by the mass and spring components of the resonant bridge 108.

A feature of the inventive electric guitar is to use a compact module having mechanical elements to imitate acoustic characteristics of an acoustic guitar. Generally, acoustic guitars have resonances in the 80 to 300 Hz range defined by the top and bottom decks, guitar acoustic volume, and the sound hole dimensions. Other instruments can have resonances that are slightly lower or higher. For example, for bass guitar and other bass instruments, the resonant frequencies may be as low as, e.g., about 40 or 41 Hz. For small string instruments, the resonant frequencies defined by the top and bottom decks, the acoustic volume, and the sound hole dimensions can be as high as, e.g., about 450 Hz. The components that produce these resonances take up considerable space and make the guitar quite large.

The resonant components of acoustic guitars were analyzed, the vibration modes and acoustic/mechanical resonances were simulated, and selected springs and masses were used to produce the same acoustic/mechanical resonances but without the big and bulky acoustic guitar body. Several of the mass-spring resonators are stacked together to produce the multiple resonances similar to those in an acoustic guitar. The stack of resonators (referred to as the resonant stack) are placed under the bridge plate so that the resonators can be excited by the strings as the musician played the guitar. Because the bridge is no longer rigidly mounted on the body of the electric guitar, the guitar has a softer and more acoustic "feel" and allows the strings to couple to each other for a more acoustic sound. In some examples, a secondary electromagnetic pickup is added to sense the movements of the bridge, and the pickup signal is mixed with the traditional humbucker pickup signals to generate the complete "acoustic" signal. In some examples, the mass-spring resonators can be configured and/or adjusted to produce resonances at any specified frequencies within the desired range (e.g., 40 to 450 Hz).

In general, a mechanical resonator is a system or device that exhibits resonance or resonant behavior such that it oscillates with greater amplitude at certain frequencies referred to as resonant frequencies. The frequency at which the system tends to oscillate without any driving force is referred to as the natural frequency. In some examples, the lowest resonant frequency is also the natural frequency. An example of a mechanical resonator is a mass-spring (or spring-mass) system that includes a spring that has a spring constant k and a mass that has mass m, in which the spring has one end connected to the mass and another end that is grounded. For this system, the natural frequency is defined by $\sqrt{k/m}$. This is a single degree of freedom system of the second order that has one natural frequency. If another spring and mass are added to the system, it will be a two degree of freedom system of the fourth order and will have two natural frequencies. As more springs and masses are added to the system, the number of natural frequencies increases.

In general, there are a few resonant frequencies in each acoustic guitar (in the frequency range 80-300 Hz). Two resonant frequencies (typically lowest and the highest resonant frequencies within the 80-300 Hz range) are defined by the mechanical design of the guitar and are due to the vibrations of the top (and sometimes—bottom) deck, and a middle resonant frequency is associated with a Helmholtz resonance of the guitar sound hole. Typically, the bigger the guitar body the lower the resonant frequencies. In some implementations, the resonant bridge 108 is configured to produce the resonant frequencies mentioned above. For example, the resonant frequencies of a specific acoustic guitar can be measured, and the resonant bridge 108 can be configured to have resonant frequencies and/or damping (or losses) that substantially match those of the acoustic guitar.

Figure 2:
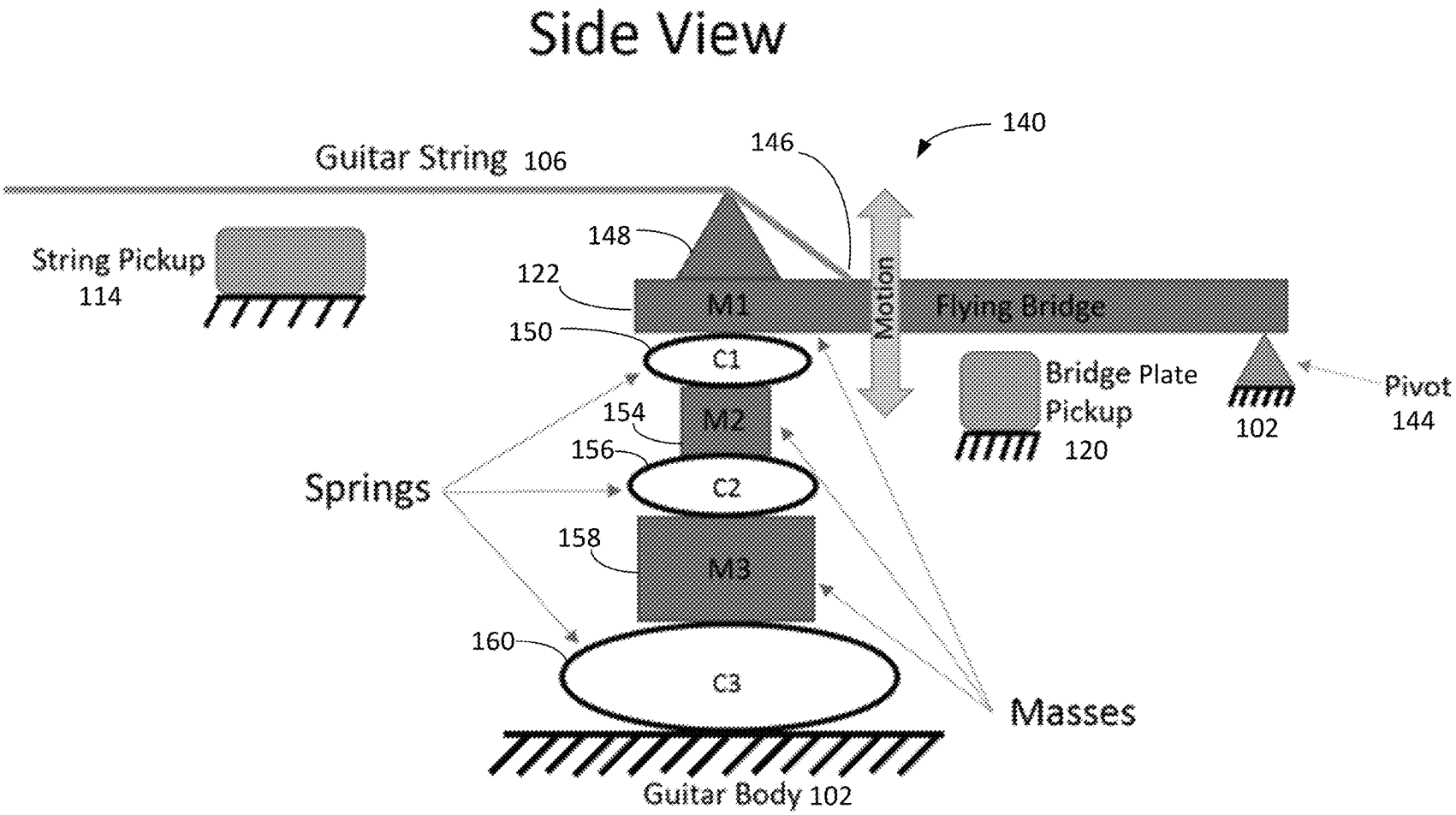
FIG. 2 is a diagram of an example resonant bridge.
Figure 3A:
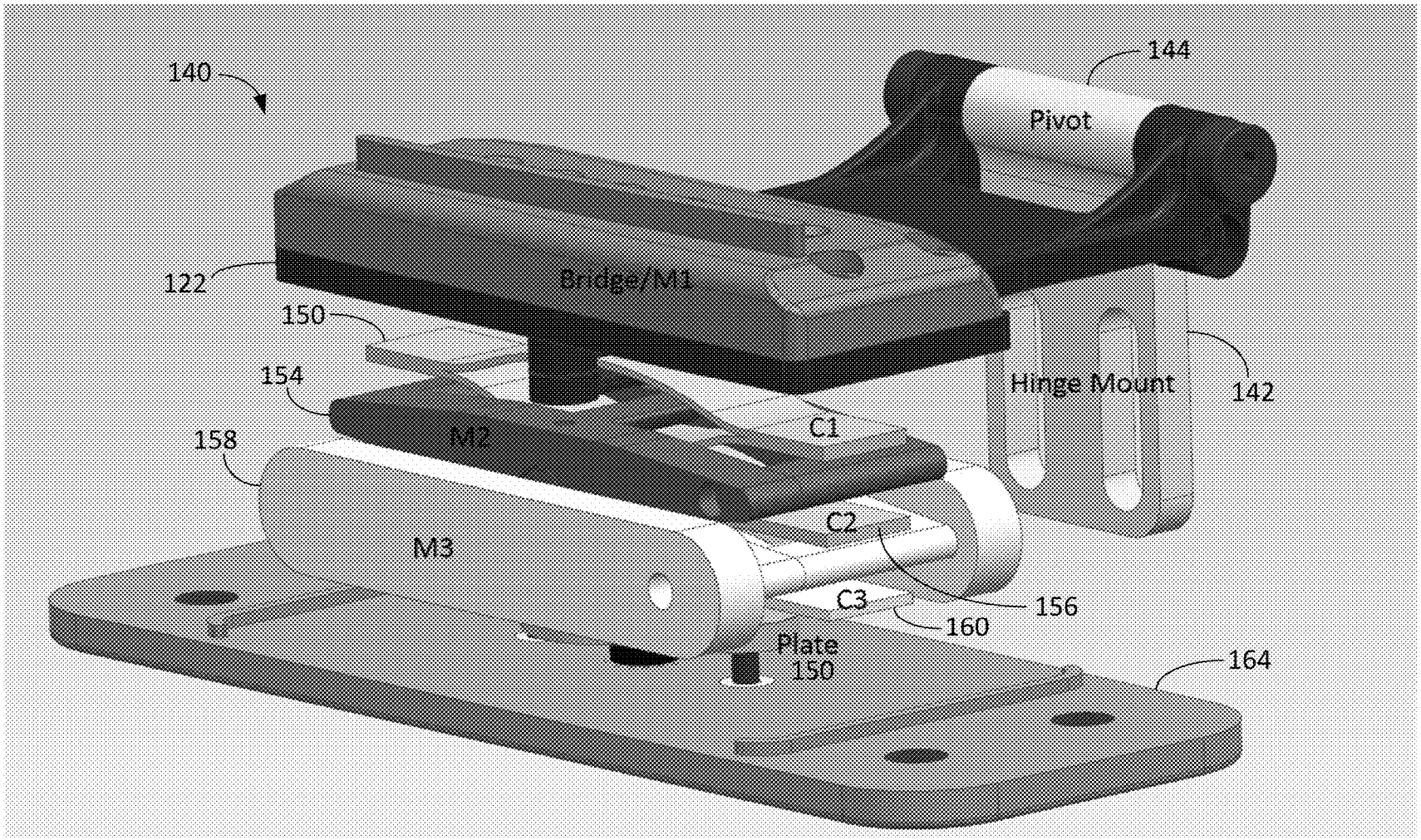
FIG. 3A is a perspective view of an example resonant bridge.
Figure 3B:
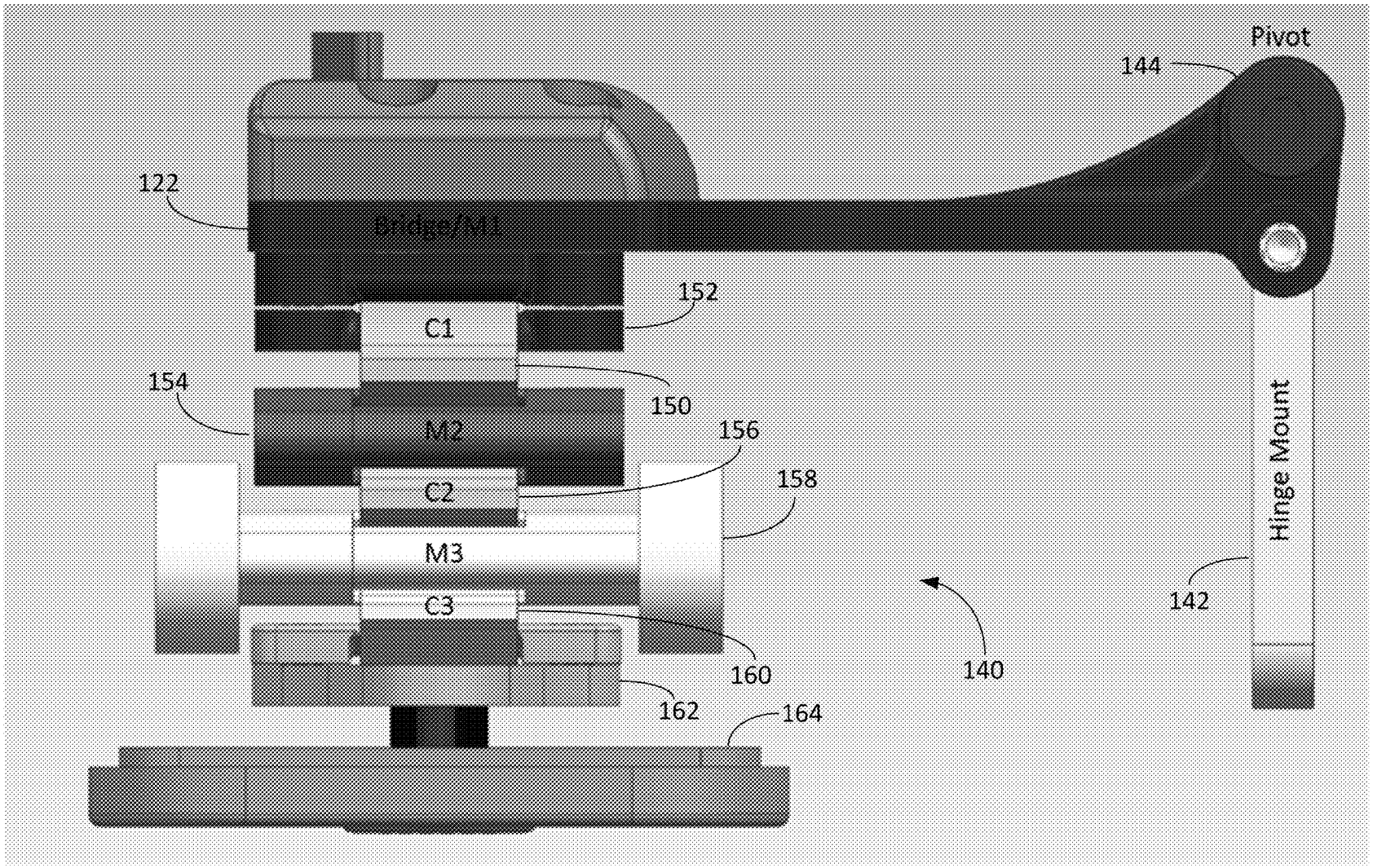
FIG. 3B is a side view of an example resonant bridge.

FIGS. 2, 3A, and 3B show an example of a three degree of freedom sixth order resonant bridge 140 that includes 3 masses (denoted M1, M2, and M3) and 3 springs (denoted C1, C2, and C3) used to produce resonant characteristics similar to those of a traditional acoustic guitar. In the description below, the notations "M1," "M2," and "M3" represent both the mass components and the corresponding mass values, and the notations "C1," "C2," and "C3" represent both the spring components and the corresponding spring constants (or spring coefficients).

In this example, the springs and masses are placed in series and constrained to only move in directions substantially orthogonal to the surface of the guitar body 102. The resonant bridge 140 includes a bridge plate 122 that has a mass M1. In some examples, in order to constrain the movements of the masses and springs to the directions substantially orthogonal to the surface of the guitar body 102, one end of the bridge plate 122 is pivotly connected to a hinge mount 142 (FIG. 3A) through a low friction pivot 144, and the hinge mount 142 is secured to the body 102 of the guitar 100. The other end of the bridge plate 122 is coupled to the mass-spring system and can move in directions substantially orthogonal to the surface of the guitar body 102, in which movements of the bridge plate 122 are modulated by the mass-spring system. An end 146 of a string 106 is attached to the bridge plate 122, in which the string 106 sits on a saddle 148 that is attached to the bridge plate 122 or is part of the bridge plate 122. The hinge mount 142 is omitted in the diagram of FIG. 2.

A first spring or compliance C1 150 (which has a spring constant C1) is attached via a clamp 152 to the bridge plate 122. A second mass M2 154 (which has a mass value M2) has a shape configured to enable it to clamp the first spring C1 150 and a second spring C2 156 (which has a spring constant C2) together. A third mass M3 158 (which has a mass value M3) has a shape configured to enable it to clamp the second spring C2 156 and a third spring C3 160 (which has a spring constant C3) together. A plate 162 (FIGS. 3A and 3B) is provided to clamp the bottom of the third spring C3 160 to ground the stack of resonators to the guitar body 102. In some embodiments, the lower end of the stack of resonators is solidly attached to the guitar body 102. The resonant stack (which includes the masses M1, M2, M3 and the springs C1, C2, C3) and the plate 162 are attached to a base plate 164, which is fastened to the guitar body 102. In this example, the components M1, C1, M2, C2, M3, and C3 are configured to move only along an axis substantially perpendicular to the upper surface of the body 102 of the guitar 100 (or substantially perpendicular to the guitar string 106 extending over the neck 104 of the guitar 100).

In this document, the upper surface of the body 102 refers to the surface of the body 102 facing the strings 106. When describing the relative positions of the masses and springs, it is assumed that the upper surface of the body 102 is facing an upward direction. Thus, when we say "the mass M1 is positioned above the mass M2," it means that the mass M1 is positioned farther away from the guitar body 102 as compared to the mass M2. The terms "up," "down," "top," "bottom," "left," and "right" are used to describe the relative positions of the components as shown in the figures. It is understood that the guitar 100 can be placed in any orientation.

In some examples, the resonant bridge 140 is configured to cover less than 10 square inches of a surface area of the body 102 of the guitar 100, i.e., the resonant bridge 140 has a footprint of less than 10 square inches. As shown in FIG. 1, the resonant bridge 108 is compact and does not significantly change the overall look of the guitar 100. In some examples, the resonant bridge 108 can have a footprint not more than 50 square inches. In some examples, the resonant bridge 108 can have a footprint not more than 30 square inches.

A simulation program, such as Pspice, can be used to estimate the spring coefficients and the mass values required to obtain the resonances in the appropriate frequency ranges. Although many combinations of spring coefficients and mass values can be used to generate the desired resonances, if the springs are too soft, the whole resonant stack may be completely compressed when the string load is applied. On the other hand, if the springs are too stiff, the guitar may lose its soft "feel," and more importantly the increase in stiffness may also require a proportional increase in mass, which can make the instrument too heavy and bulky to comfortably pick up.

For example, as a starting point, the springs and masses can be designed such that when the strings 106 are attached, the softest spring is compressed by no more than 3 mm. For example, the springs can be configured to have coefficients from 20,000 N/m to 100,000 N/m, and the masses can be configured to be in a range from 20 grams to 300 grams. In some examples, the second spring C2 140 is twice as compliant as the first spring C1 (i.e., when the same compression force is applied, the second spring will be compressed twice as much as the first spring), and the third spring C3 is three times as compliant than the first spring C1 (i.e., when the same compression force is applied, the third spring will be compressed three times as much as the first spring). In some implementations, for the springs used in the resonant bridge 140, the compliance of a spring is configured to be higher than or equal to the spring above it. If the most compliant spring is at the top, the other springs and masses positioned below the most compliant spring may not be excited properly (or may not be excited at all). In some implementations, all of the springs have the same spring coefficient.

Figure 4:
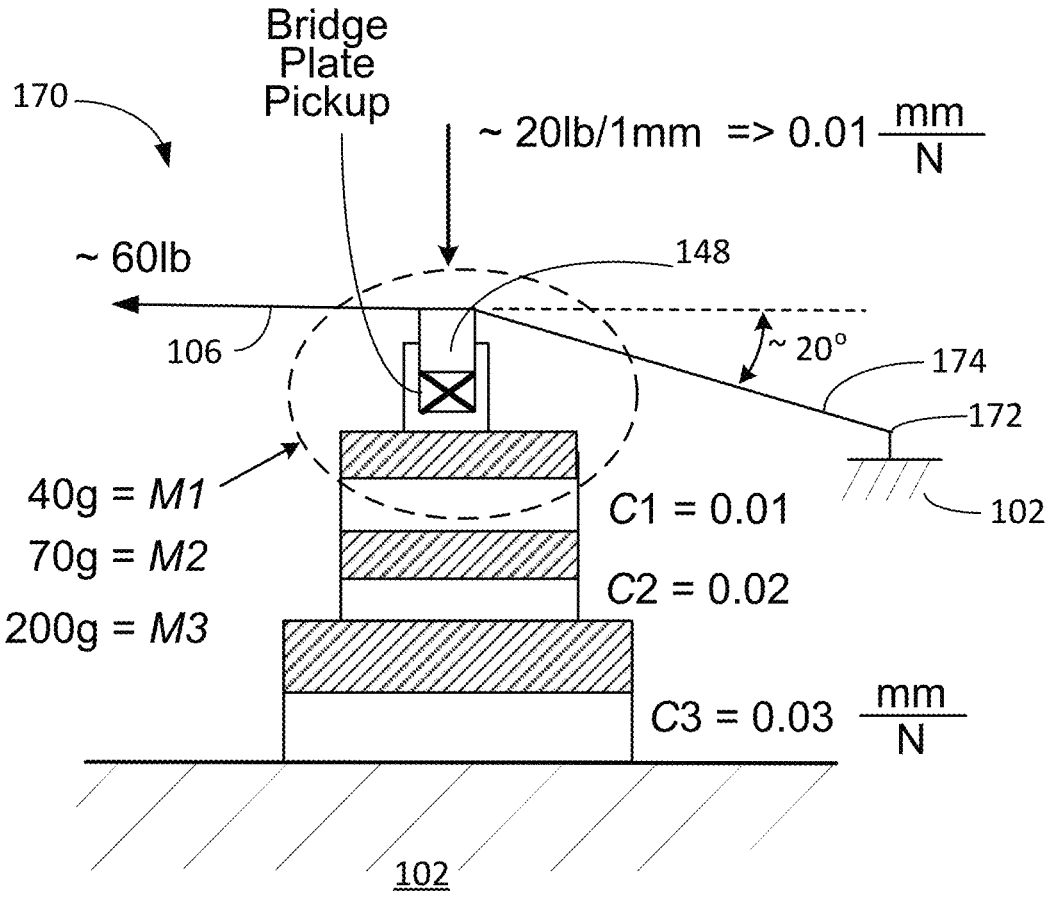
FIG. 4 is a diagram of another example resonant bridge.

FIG. 4 shows an example configuration for a resonant bridge 170. In this example, strings 106 sit on the saddle 148 and has an end 172 connected to the body 102 of the guitar 100. For example, the strings 106 have a tension of about 60 lbs., and a string segment 174 between the saddle 148 and the end 172 is at an angle of about 20° relative to the upper surface of the guitar body 102. The downward force from the strings 106 that pushes down against the saddle 148 (and the resonant stack) is about 20 lbs. If the softest spring (C3) is designed so that it compresses by no more than 3 mm, and assuming that the largest compression force is about 100 N, then the third spring coefficient C3 can be selected to be about 0.03 mm/N. The second spring coefficient C2 should be smaller than or equal to the third spring coefficient. For example, the second spring coefficient C2 can be 0.02 mm/N. The first spring coefficient C1 should be smaller than or equal to the second spring coefficient. For example, the first spring coefficient C1 can be 0.01 mm/N. The first mass M1 should be smaller than the second mass M2, which in turn should be smaller than the third mass M3. For example, the first mass M1 can be 40 g, the second mass M2 can be 70 g, and the third mass M3 can be 200 g. The design principles described above can also be used to determine the mass values M1, M2, M3 and spring coefficients C1, C2, and C3 for the resonant bridge 140 shown in FIGS. 2, 3A, and 3B.

For example, the three degree of freedom sixth order resonant bridge 140 can have a first resonant frequency, a second resonant frequency, and a third resonant frequency that depend on the first mass M1, the second mass M2, the third mass M3, the first spring coefficient C1, the second spring coefficient C2, and the third spring coefficient C3. When the musician plays the electric guitar 100 by strumming the strings 106, the vibrations of the strings 106 cause the bridge plate 122 to oscillate, and the bridge plate pickup 120 generates a pickup signal that has a frequency spectrum having a first peak at the first resonant frequency, a second peak at the second resonant frequency, and a third peak at the third resonant frequency.

For example, the center of mass of the first spring C1 can be positioned between the center of mass of the bridge plate 122 and the center of mass of the second mass M2 154 along a direction orthogonal to the upper surface of the guitar body 102. The center of mass of the second spring C2 can be positioned between the center of mass of the second mass M2 154 and the center of mass of the third mass M3 158 along the direction orthogonal to the upper surface of the guitar body 102. The center of mass of the third spring C3 160 can be positioned between the center of mass of the third mass M3 158 and the guitar body 102 along the direction orthogonal to the upper surface of the guitar body 102.

For example, the bridge plate 122 can be directly or indirectly coupled to the first spring C1 150, the first spring C1 150 can be directly or indirectly coupled to the second mass M2 154, the second mass M2 154 can be directly or indirectly coupled to the second spring C2 156, the second spring C2 156 can be directly or indirectly coupled to the third mass M3 158, the third mass M3 158 can be directly or indirectly coupled to the third spring C3 160, and the third spring C3 160 can be directly or indirectly coupled to the guitar body 102.

For example, the bridge plate 122 and the first spring C1 150 are configured such that when the bridge plate 122 vibrates, at least a portion of the vibration is transmitted to the second mass M2 154 through the first spring C1 150. The second mass M2 154 and the second spring C2 156 are configured such that when the second mass M2 154 vibrates, at least a portion of the vibration is transmitted to the third mass M3 158 through the second spring C2 156.

For example, the bridge plate 122, the first spring C1 150, the second mass M2 154, the second spring C2 156, the third mass M3 158, and the third spring C3 160 can be configured so that the bridge plate 122, the second mass M2 154, and the third mass M3 158 primarily oscillate along directions substantially orthogonal to the upper surface of the guitar body 102.

In some implementations, one or more of the springs (e.g., C1, C2, and/or C3) can have an adjustable spring constant, in which the resonant frequency can be modified by adjusting the spring constant. For example, the spring can include an air cylinder in which the pressure or volume in the air cylinder is adjustable to vary the spring constant. For example, the adjustment of the spring constant can be performed manually. For example, a controller can be configured to control the adjustable spring constant(s) to adjust the resonant frequency (or frequencies) of the resonant bridge. For example, one or more weights can be provided to adjust the mass associated with the bridge plate 122, the second mass M2 154, and/or the third mass M3 158, resulting in an adjustment of one or more of the resonant frequencies of the resonant bridge 140. For example, the weights can be magnetically coupled to the bridge plate 122, the second mass M2 154, and/or the third mass M3 158.

In some examples, the resonances of the resonant bridge 140 affects the signals picked up by the bridge plate pickup 120, but the resonant bridge 140 does not generate a significant sound level that is directly audible. This in contrast to a resonator guitar that has a resonator cone that projects loud audible sounds. For example, the electric guitar 100 can be configured to output a specified maximum unamplified audio level measured at a specified distance from the guitar 100 when the strings 106 are strummed, and the resonant bridge 140 is configured to produce no audible sound or a sound that is negligible to the player without electric amplification when the electric guitar 100 outputs the specified maximum unamplified audio level.

In the examples of FIGS. 2 to 4, each of the masses M1, M2, and M3 has a single degree of freedom, and each of the springs C1, C2, and C3 has a single degree of freedom. However, other configurations are also possible. For example, one or more of the masses can have two or more degrees of freedom. One or more of the springs can have two or more degrees of freedom.

Figure 5:
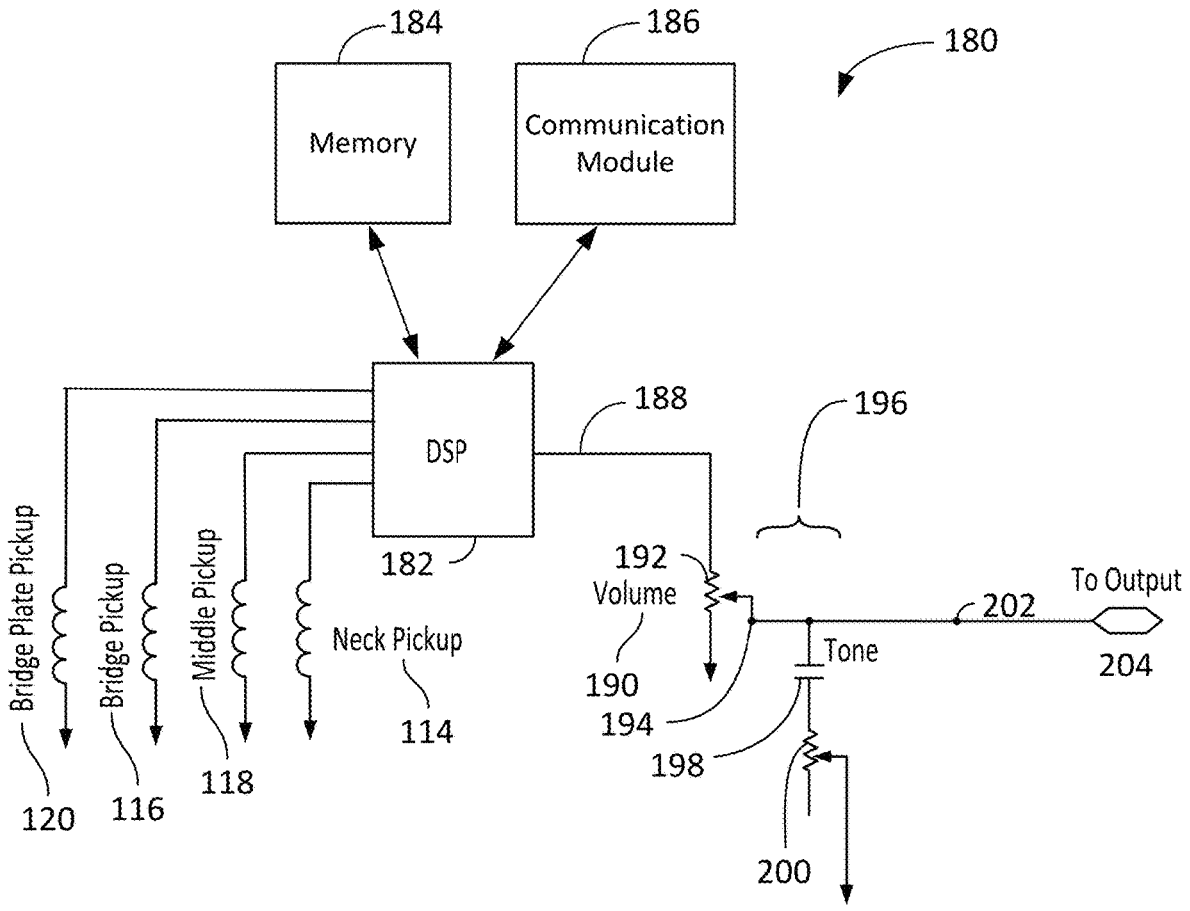
FIG. 5 is a circuit diagram of an example electric system of the electric guitar.

FIG. 5 shows a circuit diagram of an example electric system 180 of the electric guitar 100. The electric system 180 includes a digital signal processor (DSP) 182 that receives signals from the neck pickup 114, the bridge pickup 116, the middle pickup 118, and the bridge plate pickup 120. The neck pickup 114, the bridge pickup 116, and the middle pickup 118 detect the string vibrations, whereas the bridge plate pickup 120 detects the vibrations of the resonant bridge 140. In some examples in which a locking mechanism is provided to allow the user to selectively lock the resonant bridge 140 to prevent the bridge plate 122 from vibrating, the bridge plate pickup 120 does not detect any vibration from the bridge plate 122 when the resonant bridge 140 is locked.

The digital signal processor (DSP) 182 can process the signals from the neck pickup 114, the bridge pickup 116, the middle pickup 118, and the bridge plate pickup 120, and apply various equalization curves and sound effects. The digital signal processor 182 includes, e.g., an analog-to-digital converter that digitizes the input signals to generate digital samples of the input signals. The digital audio data are processed using digital processing algorithms. For example, the digital signal processor 182 can apply a selected frequency response curve to the pickup signal from the neck pickup 114, the bridge pickup 116, the middle pickup 118, or the bridge plate pickup 120, in which the selected frequency response is selected from a plurality of pre-stored frequency response curves. For example, a memory device 184 is provided to store data representing the pre-stored frequency response curves.

For example, the digital signal processor 182 can apply a first selected frequency response curve to the pickup signal from the neck pickup 114, apply a second selected frequency response curve to the pickup signal from the bridge pickup 116, apply a third selected frequency response curve to the pickup signal from the middle pickup 118, and apply a fourth selected frequency response curve to the pickup signal from the bridge plate pickup 120, in which each of the selected frequency responses is selected from a plurality of pre-stored frequency response curves. For example, the digital signal processor 182 can combine the pickup signals from the neck pickup 114, the bridge pickup 116, the middle pickup 118, and the bridge plate pickup 120 to generate a combined pickup signal, and then apply a selected frequency response curve to the combined pickup signal, in which the selected frequency response is selected from a plurality of pre-stored frequency response curves. Each of the plurality of frequency response curves is configured to enable the digital signal processor 182 to modify the pickup signal to mimic a particular guitar or a particular group of guitars.

In some implementations, the digital signal processor 182 is coupled to a communication module 186 that communicates with a computer, such as a desktop computer or a laptop computer, through e.g. a USB cable. For example, a user interface is provided on the computer to allow the user to adjust the frequency response curve that the digital signal processor 182 applies to the guitar sound. In some implementations, the communication module 186 communicates wirelessly with a mobile phone, and a software app is provided on the mobile phone to allow the user to adjust the frequency response curve or to select multiple effects and sounds that the digital signal processor 182 applies to the guitar sound. The app can provide a menu of predetermined frequency response curves. Each frequency response curve can be associated with a particular guitar or a brand of guitar that has a particular guitar tone.

The digital signal processor 182 can combine the detection signals from the neck pickup 114, the bridge pickup 116, the middle pickup 118, and the bridge plate pickup 120, or processed versions of those signals, in the digital domain, and use a digital-to-analog converter (DAC) to convert the digital signals to analog signals. The digital signal processor 182 generates an analog output signal 188 that is provided to a volume control unit 190, which includes a potentiometer 192. The user can manually adjust the signal level at the potentiometer 192 using the volume control knob 126 on the body 102 of the electric guitar 100. The output of the volume control unit 190 is connected to a node 194, which is connected to a tone control unit 196 that includes a capacitor 198 and a variable resistor 200. The user can manually adjust the resistance of the variable resistor 200 using the tone control knob 128 on the body 102 of the electric guitar 100. The signal 202 at the node 194 is provided to an output jack 204, which can be connected to an external amplifier.

Some components are omitted from FIG. 5. For examples, one or more analog-to-digital (A/D) converters can be provided internal or external to the DSP 182 for digitizing the signals from the pickups 114, 116, 118. One or more digital-to-analog (D/A) converters can be provided internal or external to the DSP 182 for converting the digital signals to the analog output signal 188. An interface circuit can be provided between the pickups and the A/D converters.

For example, the electric guitar 100 can include an electronic circuit configured to combine the string pickup signal (e.g., provided by the neck pickup 114, bridge pickup 116, and/or middle pickup 118) with the bridge plate pickup signal (provided by the bridge plate pickup 120) to generate a combined output signal. For example, the electric guitar can include an electronic circuit to process the string pickup signal and/or the bridge plate pickup signal. The electric guitar 100 can include a switch that is configured to select between a first mode and a second mode, in which when the first mode is selected, the electronic circuit is configured to combine the string pickup signal and the bridge plate pickup signal to generate a combined output signal that is provided to the output jack 204 of the electric guitar 100. When the second mode is selected, the electronic circuit is configured to provide the string pickup signal to the output jack 204. For example, the string pickup signal is configured to have sound characteristics that resemble those of a conventional electric guitar, and the mixed output signal is configured to have sound characteristics that more closely resemble those of a conventional acoustic guitar.

For example, the resonant frequencies of the resonant bridge 140 picked up by the bridge plate pickup 120 can correspond to resonant frequencies of an acoustic guitar defined by the top and bottom decks of the acoustic guitar, the acoustic volume of the acoustic guitar, and/or the sound hole dimension of the acoustic guitar. In some examples, the resonant frequencies of the resonant bridge 140 can be in a range between 40 Hz to 450 Hz. In some examples, the resonant frequencies of the resonant bridge 140 can be in a range between 80 Hz to 300 Hz. For example, for a regular size electric guitar, the resonant bridge 140 can have two or more resonant frequencies that are in the range from 80 Hz to 300 Hz. For a bass electric guitar, the resonant bridge 140 can have two or more resonant frequencies that are in the range from 40 Hz to 300 Hz. In some examples, the resonant frequencies of the resonant bridge 140 are configured to substantially match natural resonant frequencies of a specific acoustic guitar, or a specific type of acoustic guitar.

Figure 6B:
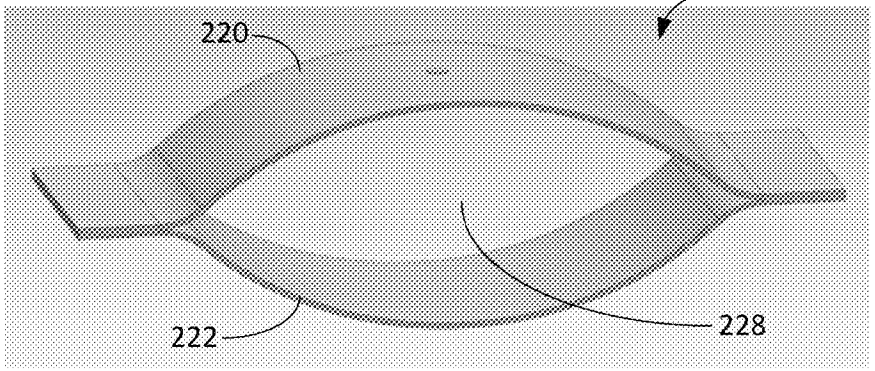
FIG. 6B is a diagram of an example of a leaf-style spring.
Figure 6A:
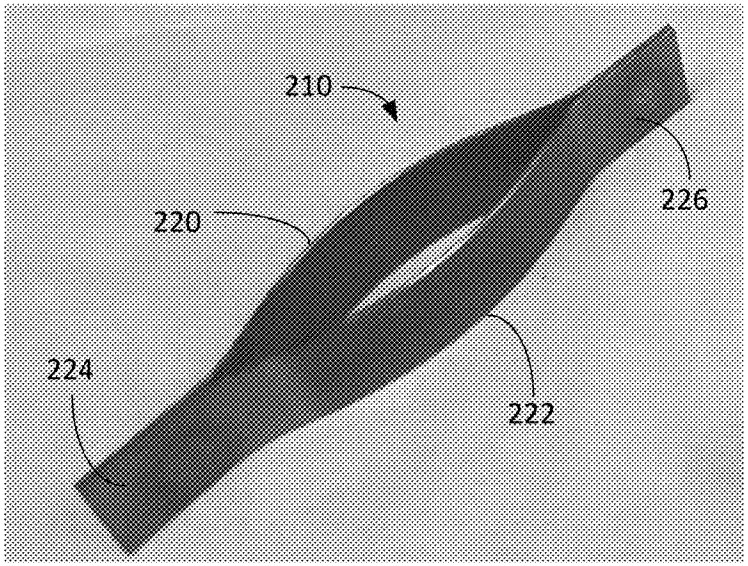
FIG. 6A is an image of an example of a leaf-style spring.
Figure 6C:
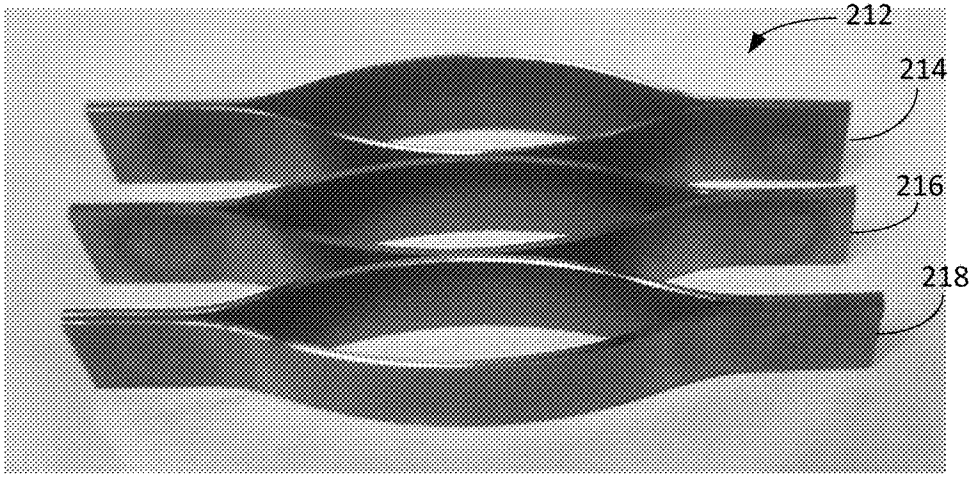
FIG. 6C is an image of an example stack of leaf-style springs.

Many types of springs can be used in the resonant bridge 140. FIGS. 6A and 6B show different views of a leaf-style spring (or leaf spring) 210 that can be used in the resonant bridge 140. The resonant bridge 140 can include a stack of leaf springs 212, as shown in FIG. 6C. The stack of leaf springs 212 can include a first leaf spring 214, a second leaf spring 216, and a third leaf spring 218. The first, second, and third leaf springs 214, 216, and 218 can correspond to the first spring C1 150, the second spring C2 156, and the third spring C3 160 in FIGS. 2, 3A, and 3B.

Referring back to FIGS. 6A and 6B, in some implementations, the leaf spring 210 can include a first flexible leaf member 220 and a flexible second leaf member 222 that are joined at a first end 224 and a second end 226. Each leaf member 220, 222 can include a thin arched steel plate having a rectangular shape. For example, the leaf spring 210 is positioned in the resonant bridge 140 such that the leaf member 220 arches upward and the leaf member 222 arches downward, with a space 228 between the leaf members 220, 222. When the leaf spring 210 is compressed, the leaf members 220, 222 move toward each other and the space 180 is reduced. This type of spring has the advantage that it takes up little space and can achieve the specific high spring constant suitable for the resonant bridge 140.

Figure 7A:
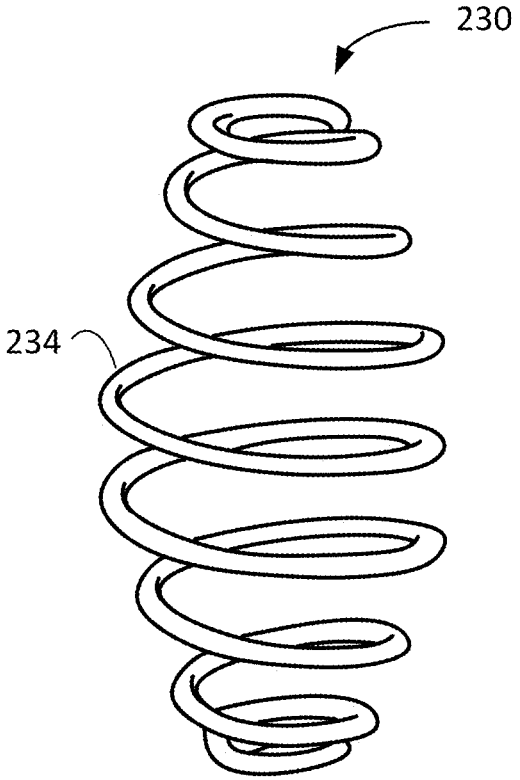
FIGS. 7A and 7B are images of examples of compression springs.
Figure 7B:
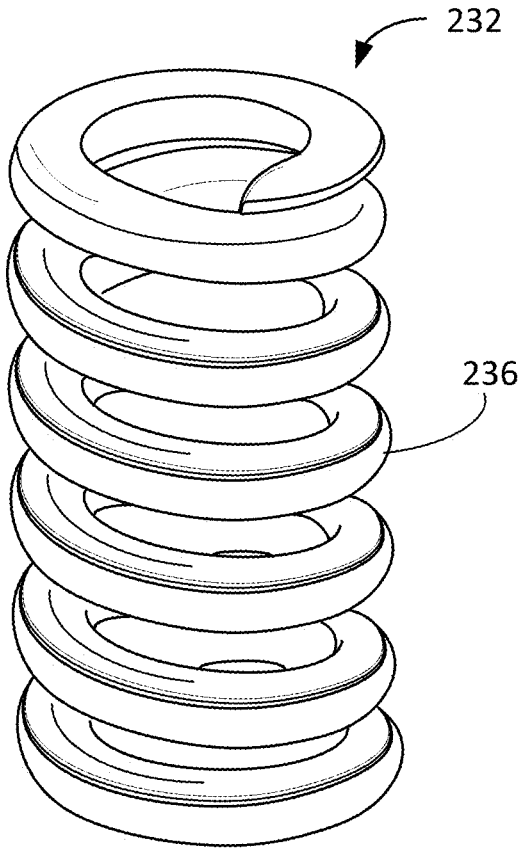

Referring to FIGS. 7A and 7B, in some examples, the resonant bridge 140 can include one or more compression springs, such as the compression spring 230 (FIG. 7A) and compression spring 232 (FIG. 7B). For example, the compression spring 230 includes a helical coil 234 in which the turns of the helical coil 234 have larger diameters near the middle and smaller diameters near the ends. For example, the compression spring 232 includes a helical coil 236 in which the turns of the helical coil 236 have substantially constant diameters.

Figure 8:
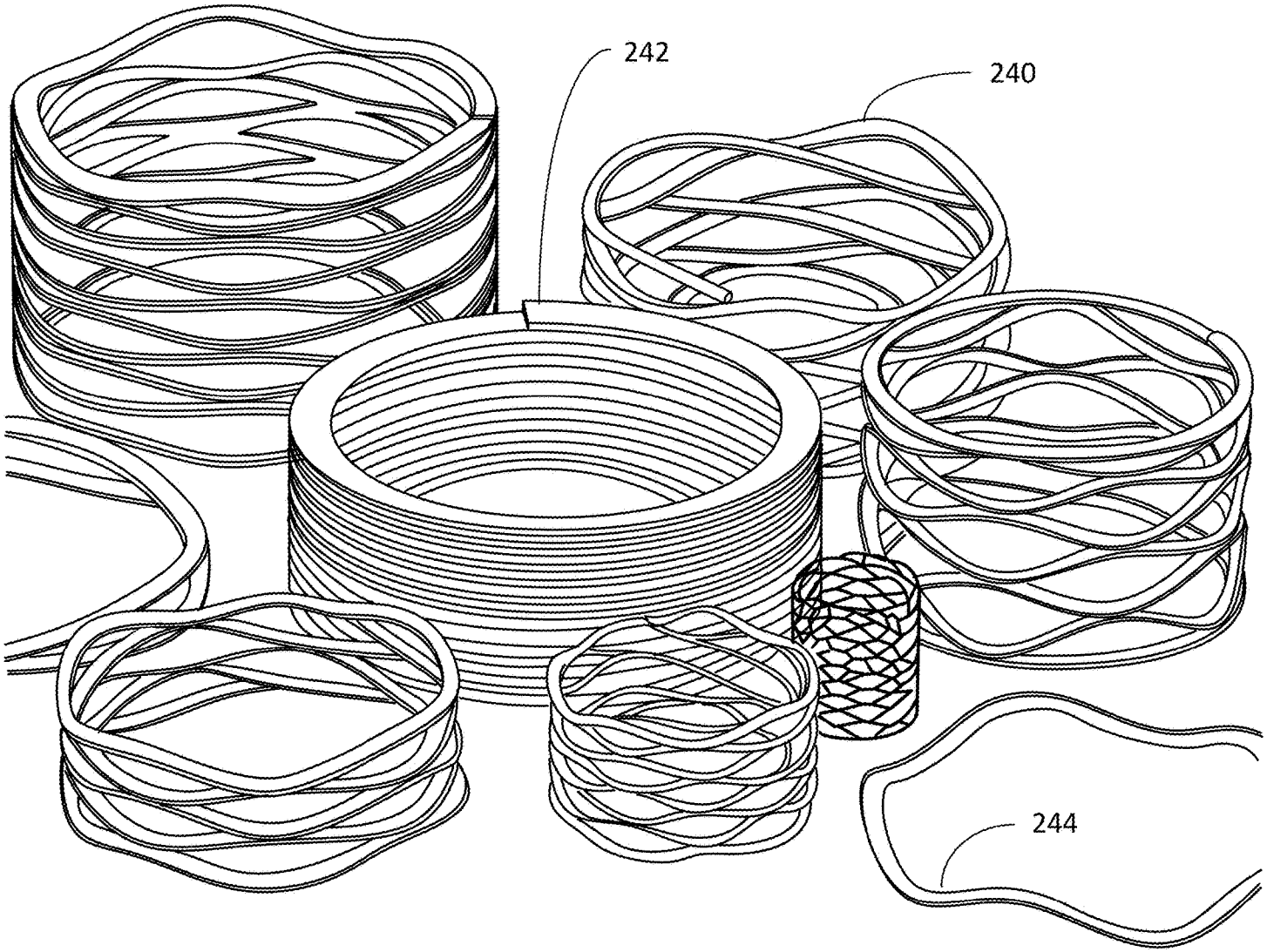
FIG. 8 is an image of examples of wave springs.

Referring to FIG. 8, in some examples, the resonant bridge 140 can include one or more metal wave style springs, such as springs 240, 242, 244. For example, a wave spring can include one or more coiled flat wires with waves added along the coils to produce a spring effect. For example, a metal wave style spring can have flexible wave-shape members, in which portions of the flexible wave-shape members are attached to each other, openings are formed between the flexible wave-shape members, and the metal wave style spring is configured to be compressible by reducing the sizes of the openings between the flexible wave-shape members.

Figure 9A:
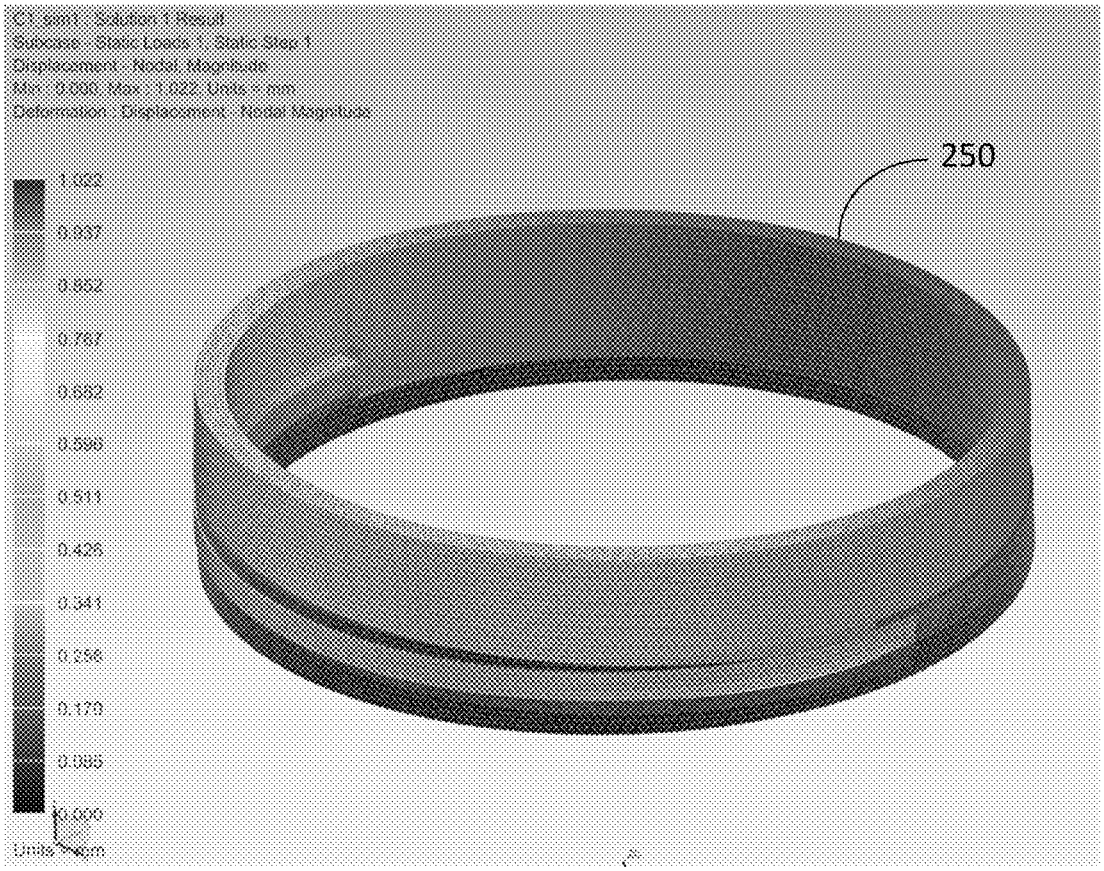
FIGS. 9A and 9B are diagrams of examples of flexure or spring designs.
Figure 9B:
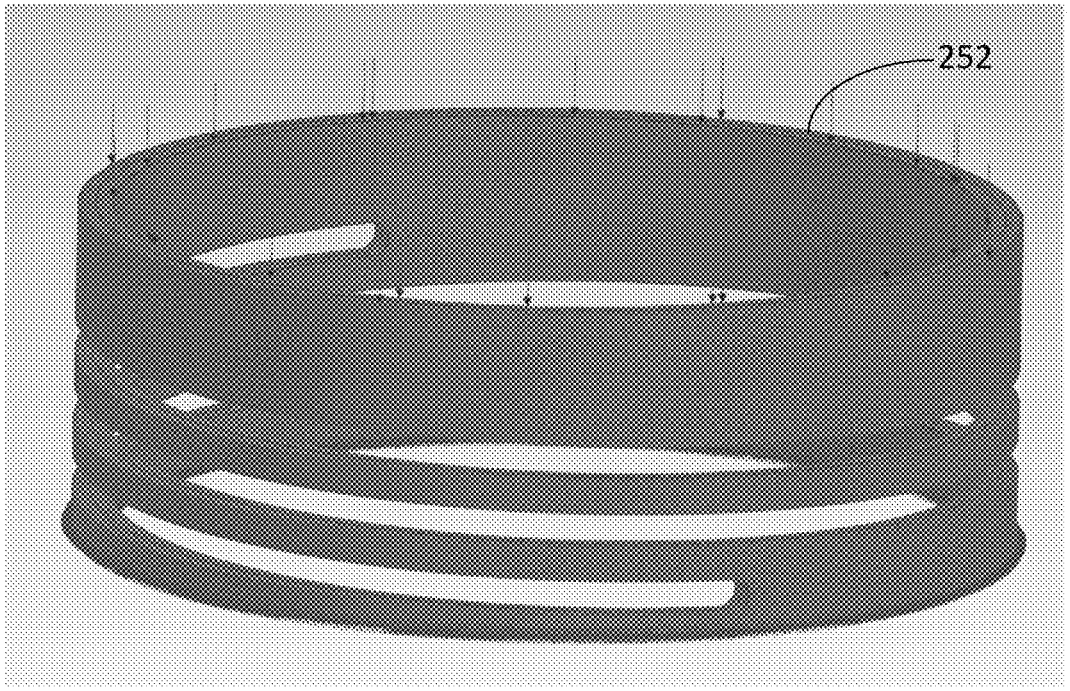

Referring to FIGS. 9A and 9B, in some examples, the resonant bridge 140 can include one or more metal machined helical springs, such as spring 250, 252. For example, a machined spring can be fabricated by cutting one or more slots in a metal or plastic tube using a CNC (computer numerical control) machine to produce a desired helical path to provide the desired elasticity for the spring.

Figure 10:
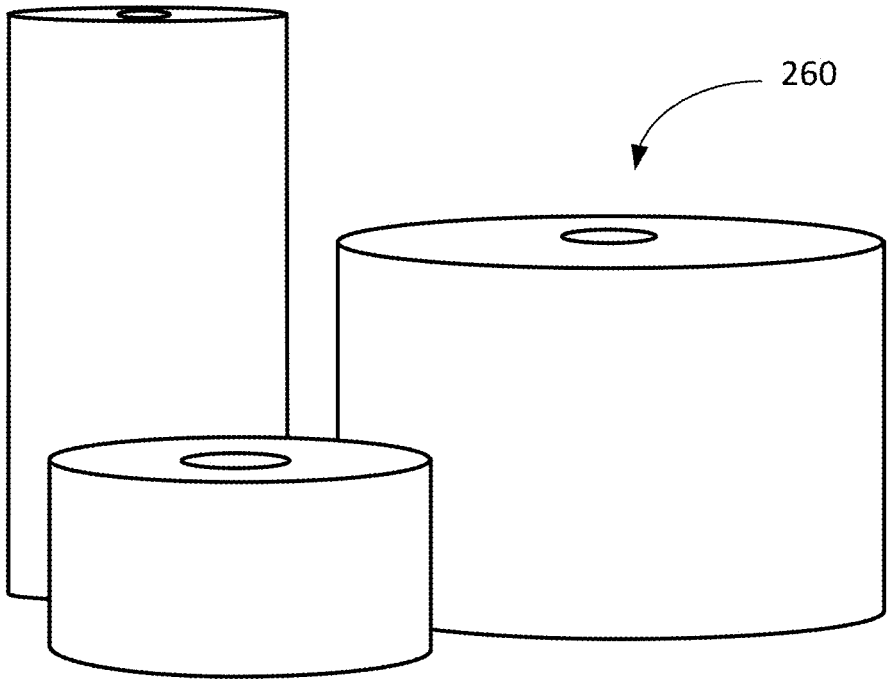
FIG. 10 is an image of example elastomers.
Figure 11:
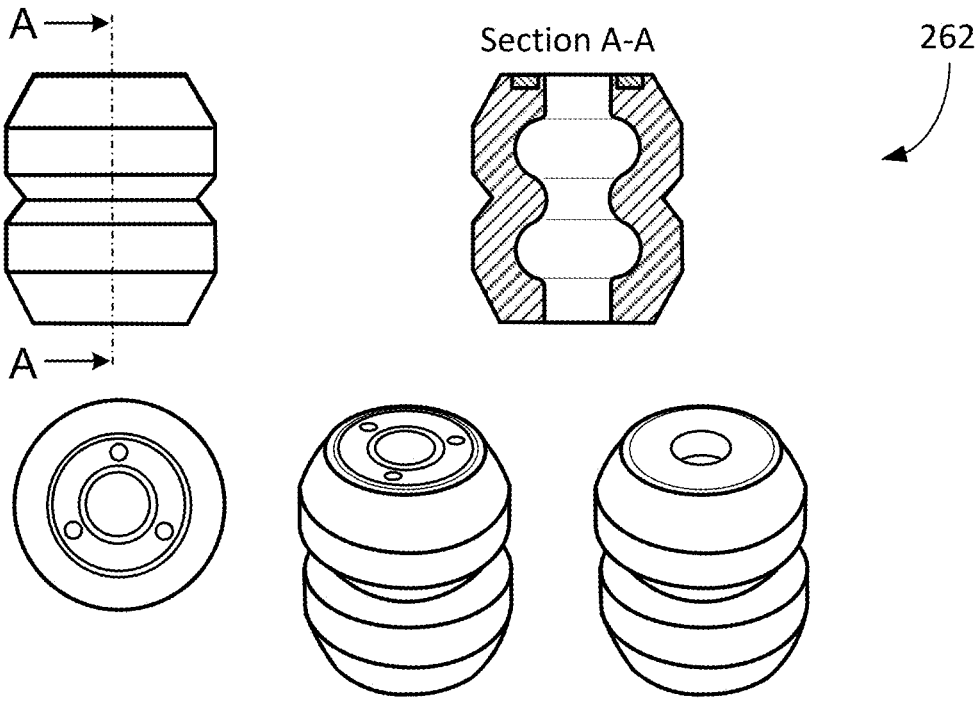
FIG. 11 is a diagram of example elastomers.

Referring to FIGS. 10 and 11, in some examples, the resonant bridge 140 can include one or more elastomer springs, such as springs 260 and 262, which can have many different geometries.

Figure 12:
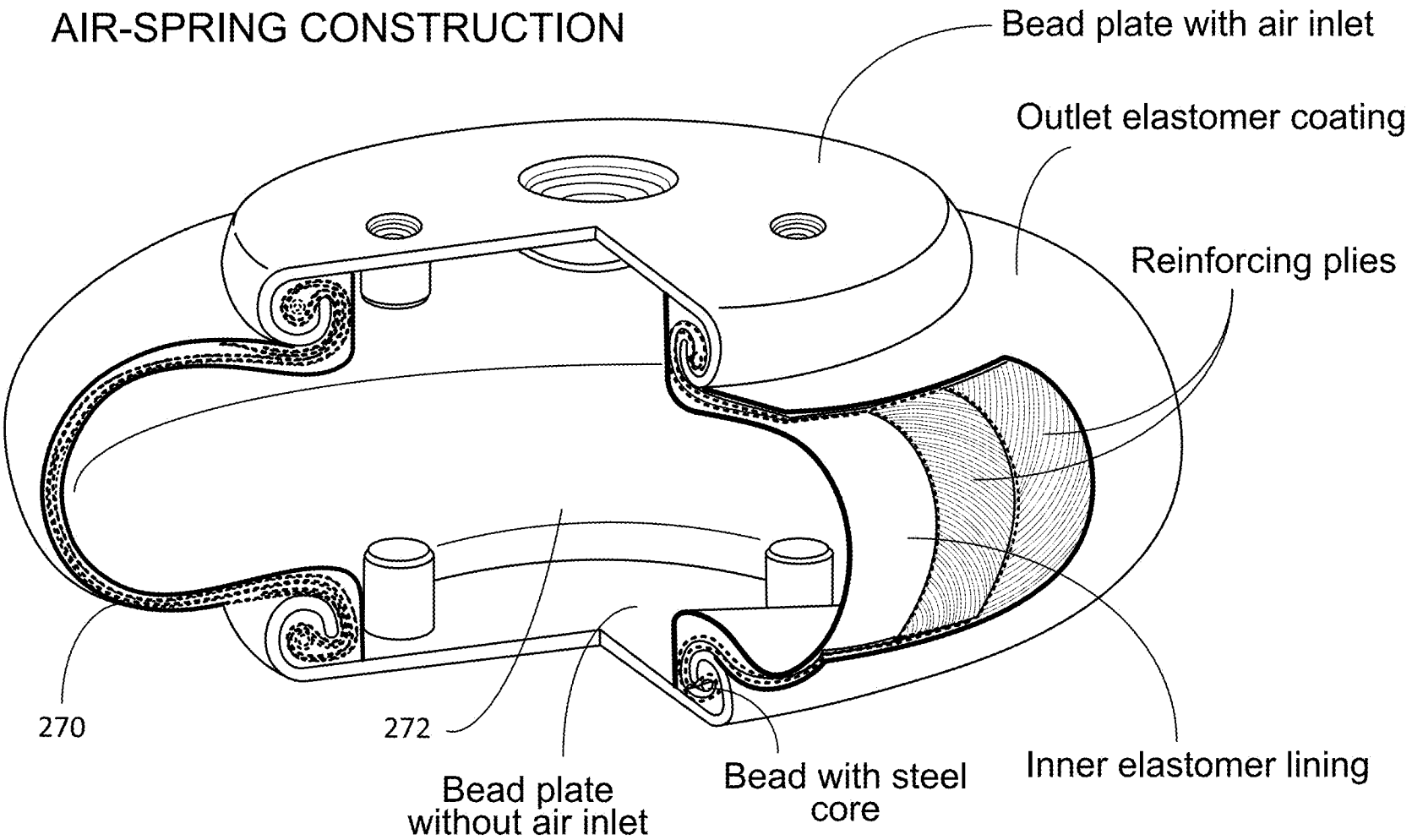
FIG. 12 is a diagram of an example air-spring.

Referring to FIG. 12, in some examples, the resonant bridge 140 can include one or more air springs 270. The air spring 270 includes an elastic bladder 272 that holds some amount of sealed air inside.

The mass members (e.g., M1, M2, M3 in FIGS. 2, 3A, and 3B) of the resonant bridge 140 can have a variety of formats. For example, the geometry for the masses in the resonant bridge 140 can be configured to correspond to the type of springs used in the system, the mass required, and the space allotted to them.

Figure 13:
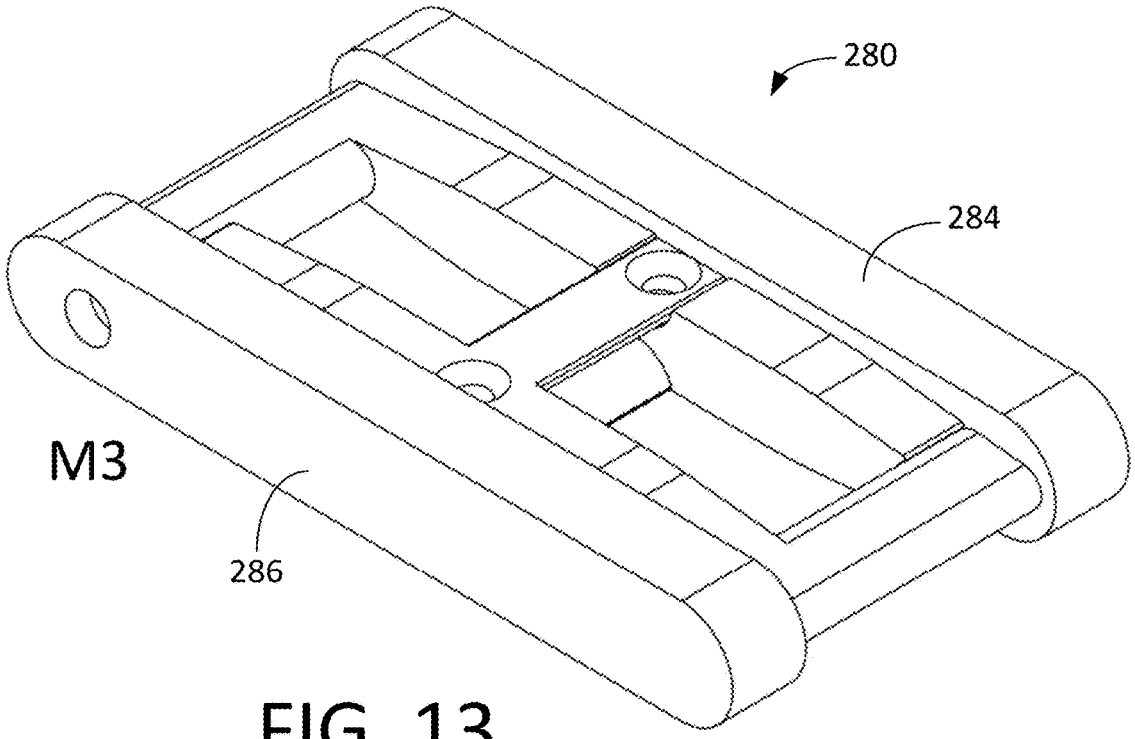
FIGS. 13 and 14 are images of example steel masses that can be used in the resonant bridge.
Figure 14:
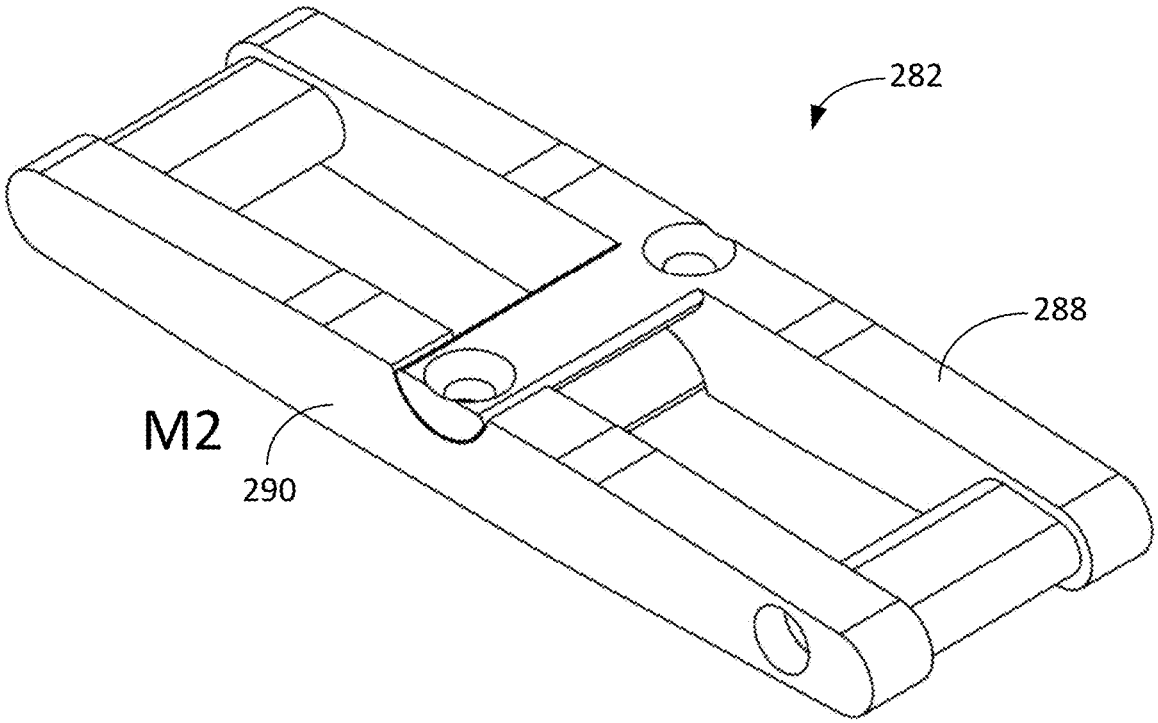

Referring to FIGS. 13 and 14, for example, the resonant bridge 140 can include a third steel mass 280 for the third mass M3, and a second steel mass 282 for the second mass M2. The third steel mass M3 280 is configured to clamp the second spring C2 156 and the third spring C3 160 together. The second steel mass M2 282 is configured to clamp the first spring C1 150 and the second spring C2 156 together.

Figure 15:
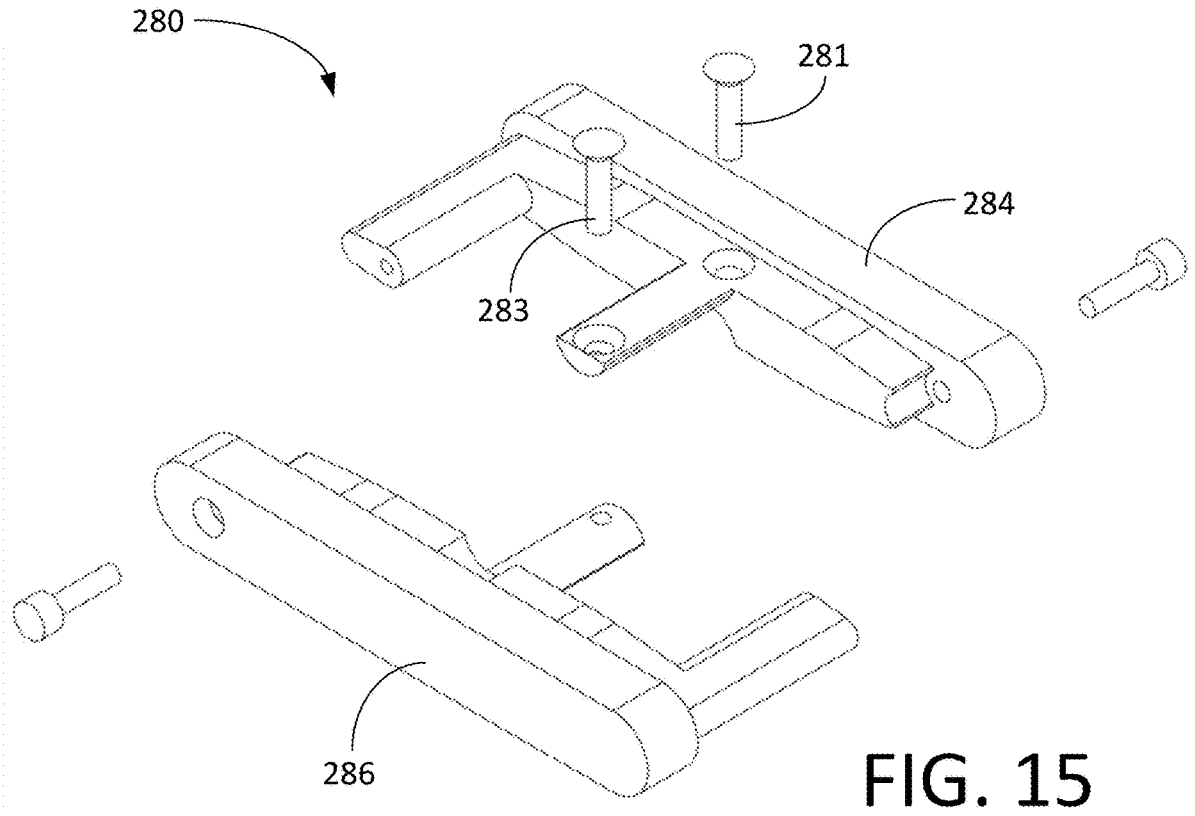
FIGS. 15 and 16 are diagrams of the example steel masses of FIGS. 13 and 14, respectively, that have been taken apart to show components.

Referring to FIGS. 13 and 15, the third steel mass M3 280 includes a first member 284 and a second member 286 that can be separated and then held together (e.g., using screws 281, 283) to clamp against portions of the second spring 156 and the third spring 160 (see FIGS. 17A-17E). FIG. 13 shows the third steel mass M3 280 with the two members 284, 286 held together, and FIG. 15 shows the third steel mass M3 280 with the two members 284, 286 separated.

Figure 16:
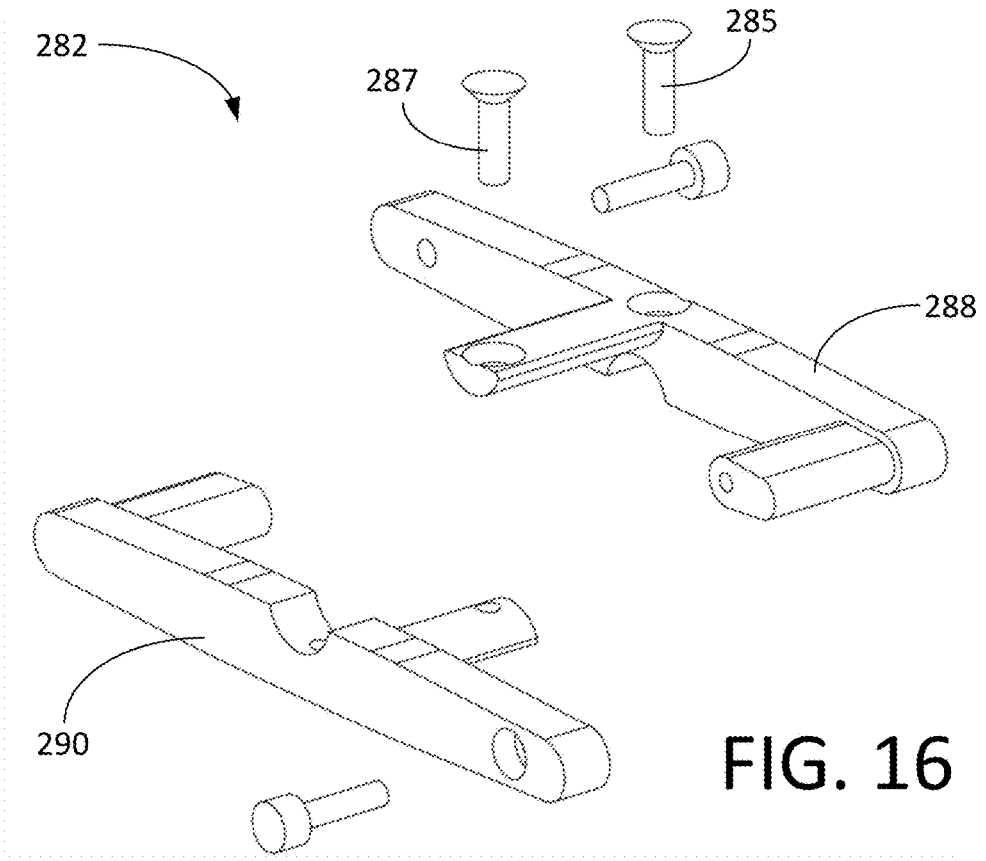

Referring to FIGS. 14 and 16, the second steel mass M2 282 includes a first member 288 and a second member 290 that can be separated and then held together (e.g., using screws 285, 287) to clamp against portions of the first spring C1 150 and the second spring C2 156. FIG. 14 shows the second steel mass M2 282 with the two members 288, 290 held together, and FIG. 16 shows the second steel mass M2 282 with the two members 288, 290 separated.

Figure 17A:
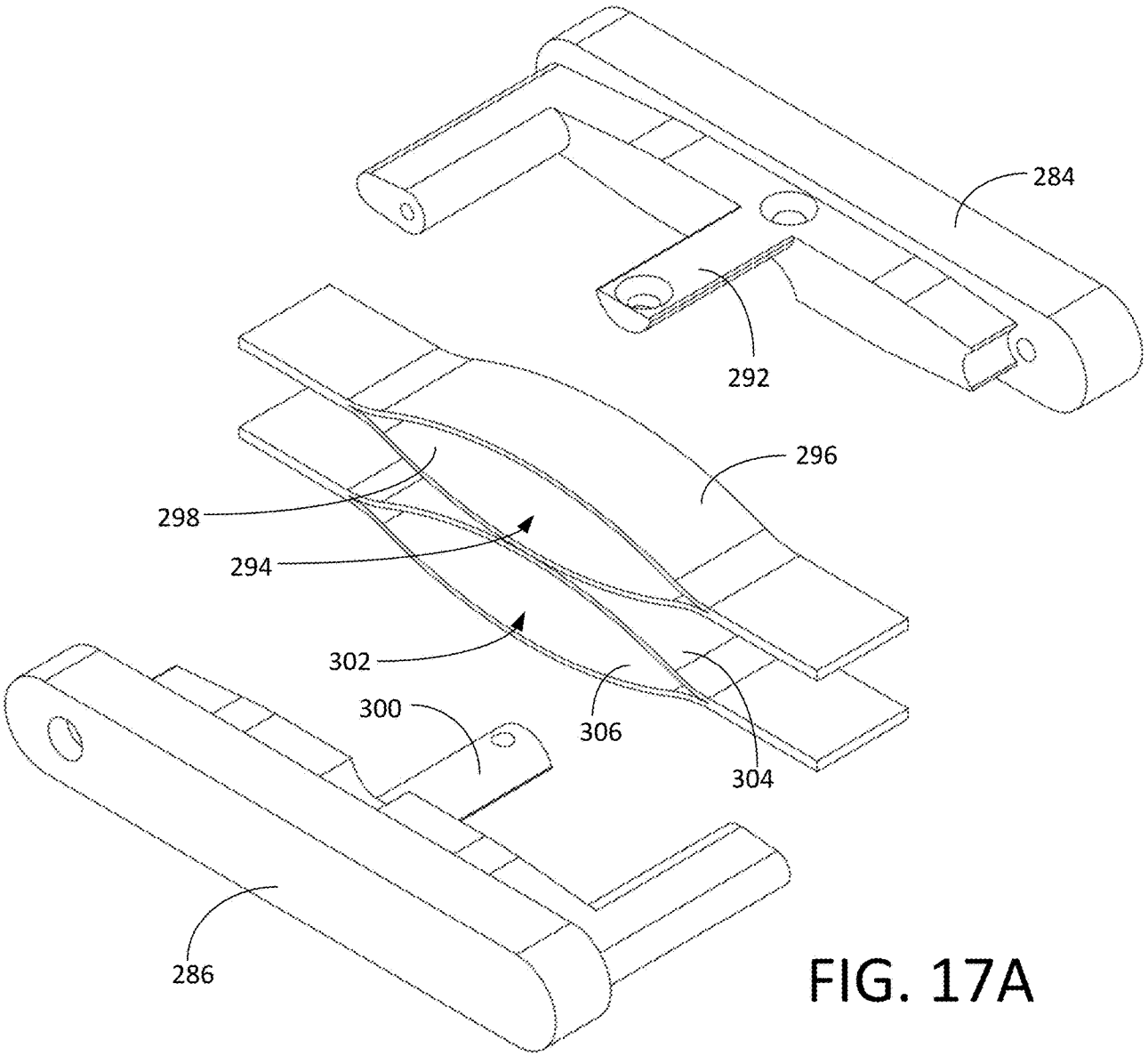
FIGS. 17A and 17B are diagrams showing members of a mass element and two leaf springs.
Figure 17B:
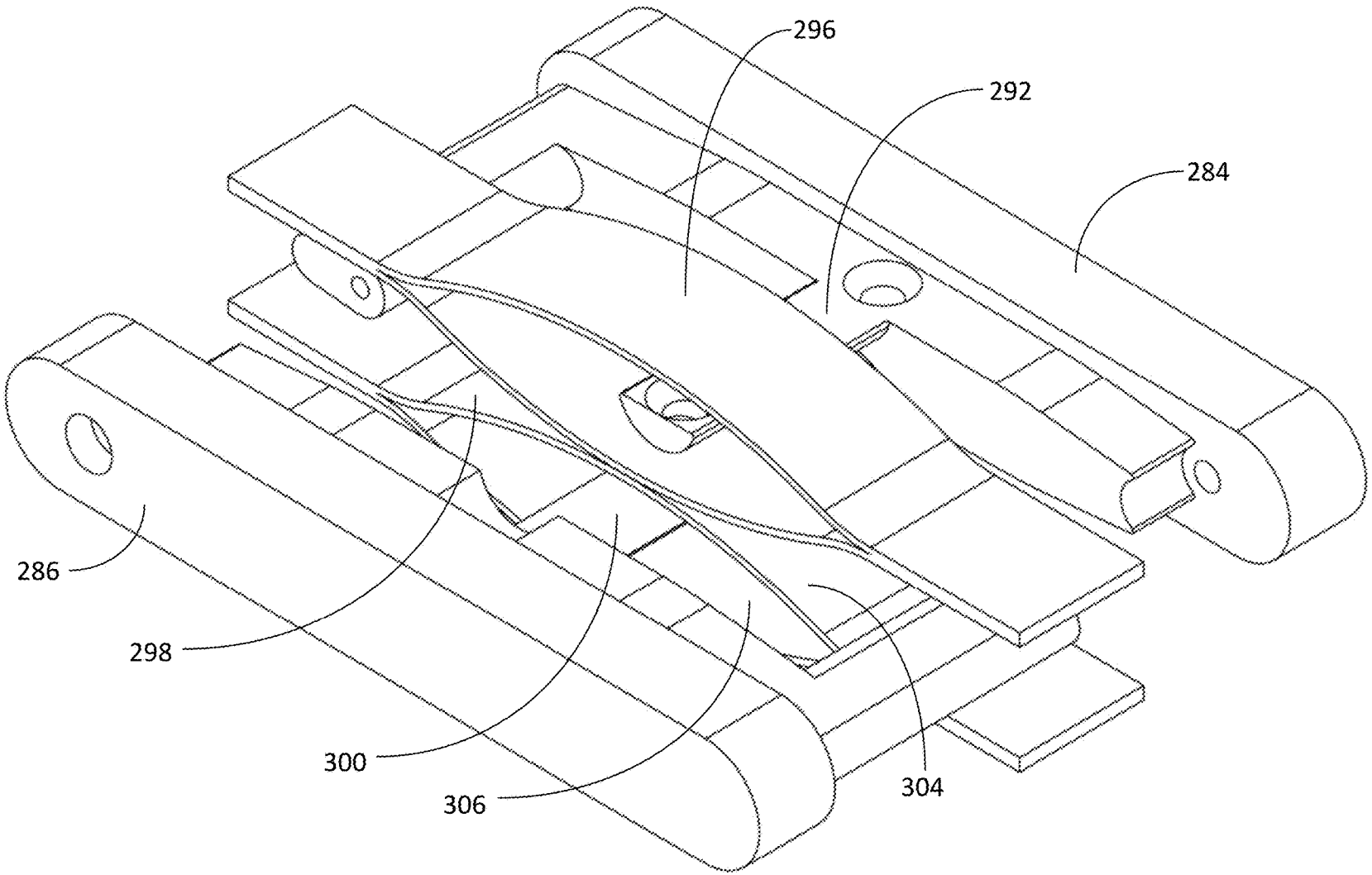
Figure 17C:
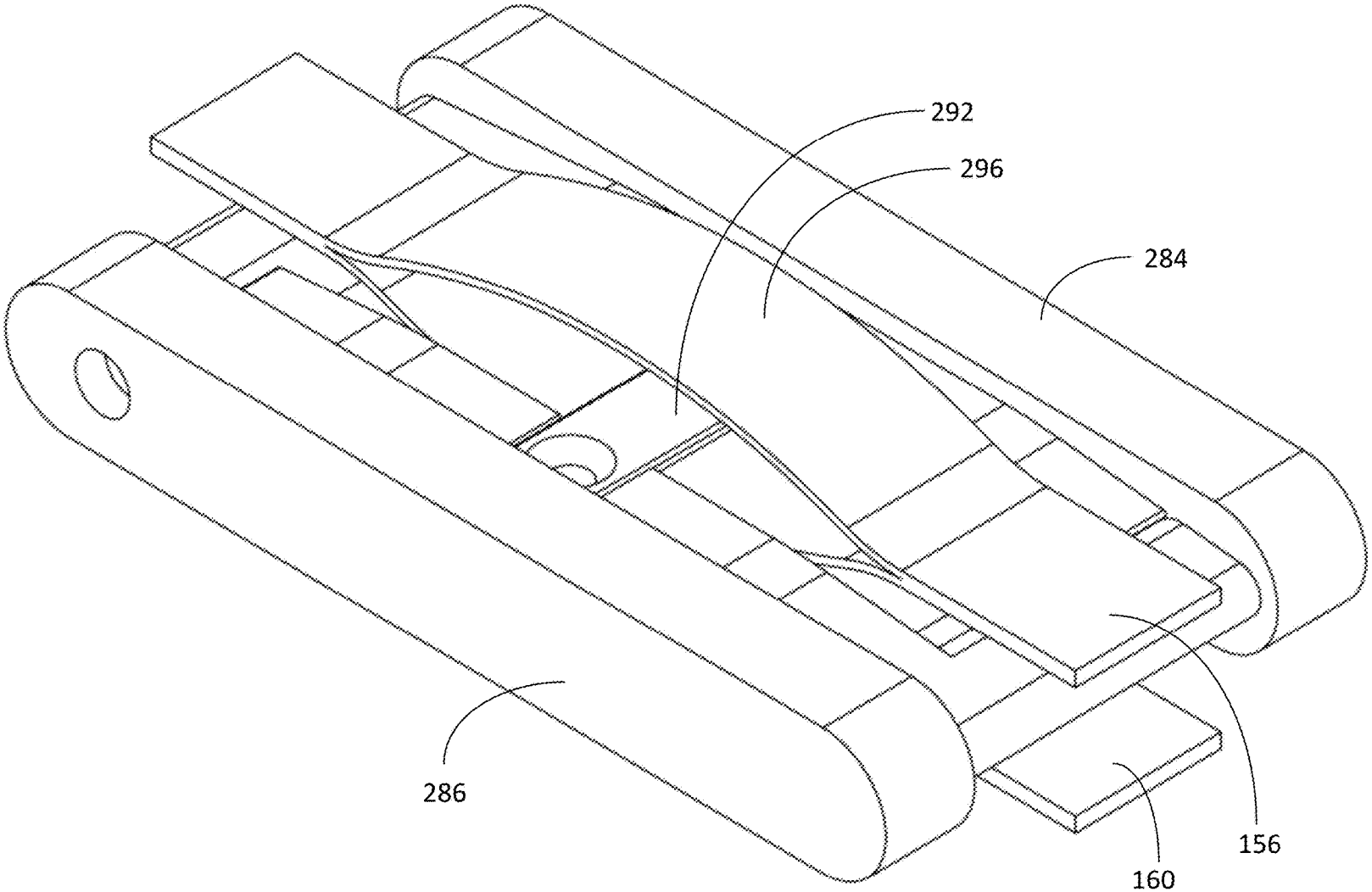
FIGS. 17C, 17D, and 17E are perspective, top, and sectional views of members of a mass element clamping two leaf springs.
Figure 17E:
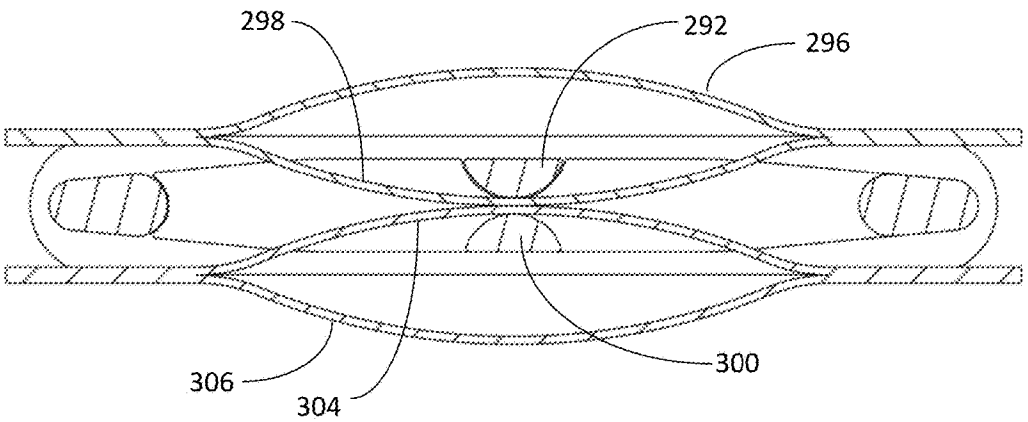
Figure 17D:
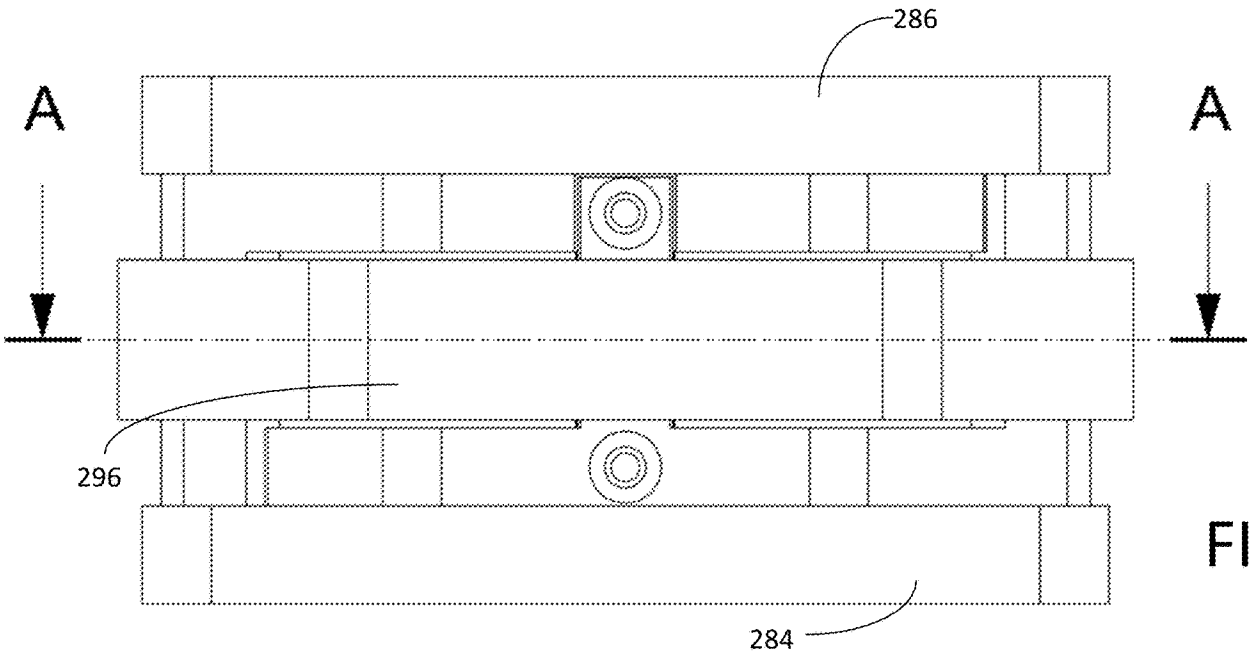

Referring to FIGS. 17A-17E, the first member 284 of the third steel mass M3 280 includes a clamp member 292 that can extend into an opening 294 between an upper leaf member 296 and a lower leaf member 298 of the second leaf spring C2 156. The second member 286 of the third steel mass M3 280 includes a clamp member 300 that can extend into an opening 302 between an upper leaf member 304 and a lower leaf member 306 of the third leaf spring C3 160. FIG. 17A shows the first member 284 and the second member 286 spaced apart from the leaf springs. FIG. 17B shows the clamp member 292 positioned in the opening 294, and the clamp member 300 positioned in the opening 302. The clamp member 292 and the clamp member 300 can be fastened (e.g., by using screws 281, 283) to clamp the lower leaf member 298 (of the second leaf spring C2 156) and the upper leaf member 304 (of the third leaf spring C3 160) together. FIG. 17C shows a perspective view of the first member 284 and the second member 296 clamping the lower leaf member of the second leaf spring C2 156 and the upper leaf member of the third leaf spring C3 160. FIG. 17D shows a top view of the first member 284 and the second member 296 clamping the lower leaf member of the second leaf spring C2 156 and the upper leaf member of the third leaf spring C3 160. FIG. 17E shows a sectional view of the clamp member 292 of the first member 284 and the clamp member 300 of the second member 296 clamping the lower leaf member of the second leaf spring C2 156 and the upper leaf member of the third leaf spring C3 160.

A middle portion of the upper leaf member 304 of the third spring C3 160 is coupled to the clamp member 300 that is part of the steel mass M3 280, and a middle portion of the lower leaf member 306 of the third spring C3 160 is coupled to the guitar body 102. Because the upper leaf member 304 and the lower leaf member 306 of the third spring C3 160 are flexible, the steel mass M3 280 can oscillate relative to the guitar body 102.

A middle portion of the lower leaf member 298 of the second spring C2 156 is coupled to the clamp member 292 that is part of the third steel mass M3 280, and a middle portion of the upper leaf member 296 of the second spring C2 156 is coupled to a clamp member of the second mass M2 282. Because the upper leaf member 296 and the lower leaf member 294 of the second spring C2 156 are flexible, the second steel mass M2 282 can oscillate relative to the third steel mass M3 280.

A middle portion of the lower leaf member of the first spring C1 150 is coupled to a clamp member of the second steel mass M2 290, and a middle portion of the upper leaf member of the first spring C1 150 is coupled to the clamp 152 that is attached to the bridge plate 122. Because the upper leaf member and the lower leaf member of the first spring C1 150 are flexible, the bridge plate 122 can oscillate relative to the second steel mass M2 282.

For the third steel mass M3 280, when the clamp members 292 and 300 are fastened together, a portion of the first member 284 is positioned on one side of the second and third leaf springs 156, 160, and a portion of the second member 286 is positioned on the other side of the second and third leaf springs 156, 160. For example, more than half of the mass of the third steel mass 280 can be positioned at the sides of the second and third leaf springs 156, 160. This way, the third steel mass 280 can have sufficient mass that is needed to produce the desired resonant frequency while also not interfering with the movements of the second and third leaf springs 156, 160 when the leaf springs are compressed or decompressed.

For example, the masses (e.g., M1, M2, M3) can be made of other denser materials, such as brass or copper to decrease the overall size. The masses can also be made from plastic, glass, or a composite material. For example, the composite material can be fiberglass and epoxy laminate, or heavy metal filled thermoplastic, such as tungsten filled nylon.

Figure 18:
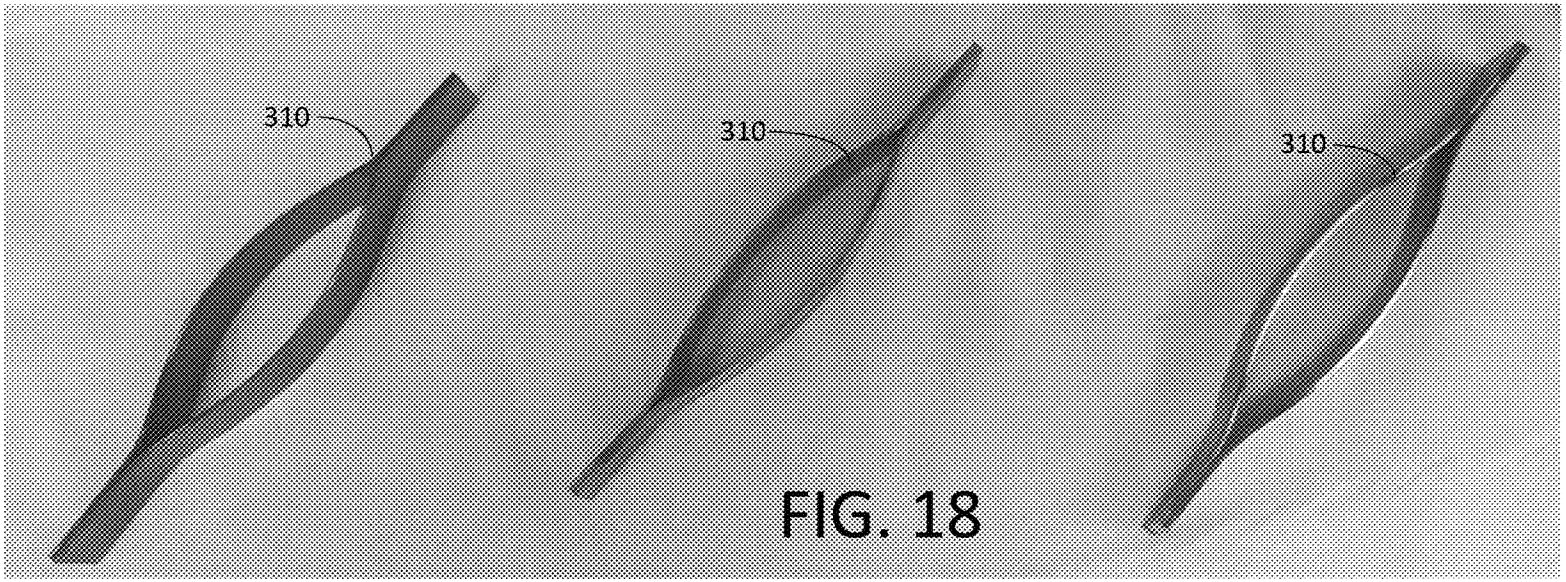
FIG. 18 is an image of example leaf springs made of bare steel.
Figure 19A:
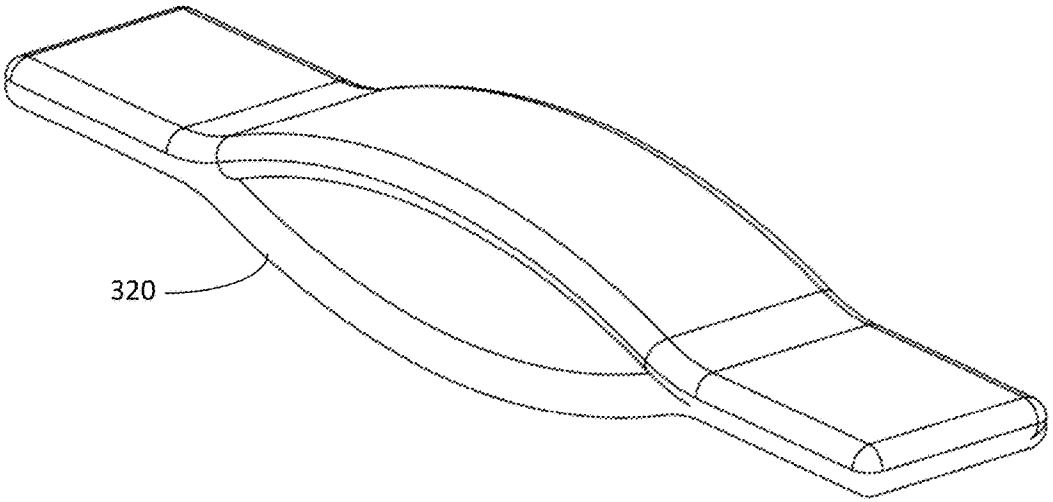
FIGS. 19A and 19B are diagrams of example leaf springs having spray-coated damper material.
Figure 19B:
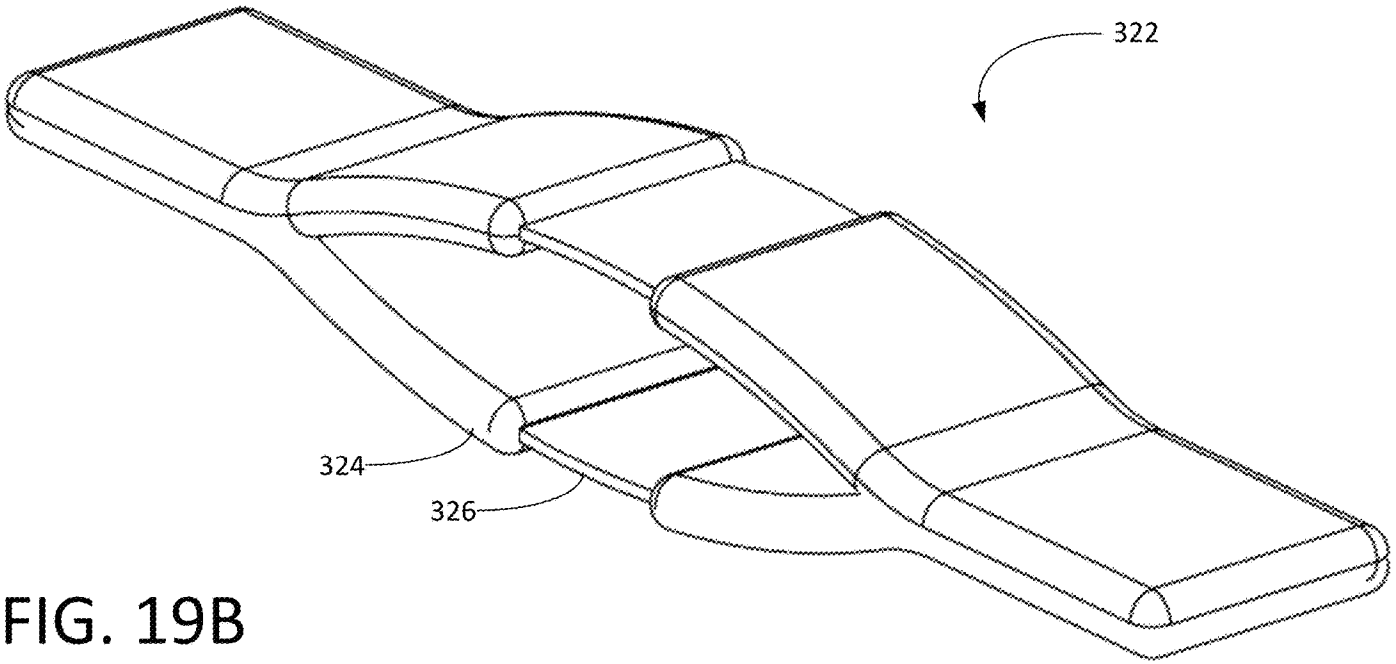
Figure 19C:
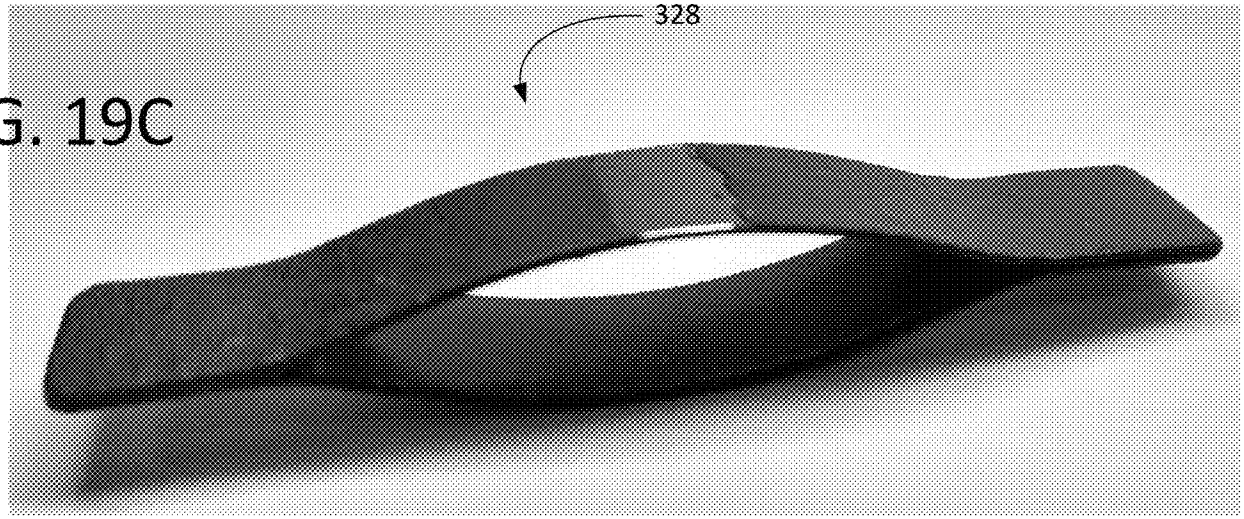
FIG. 19C is an image of an example leaf spring having spray-coated damper material.

As described in more detail below, some damping materials can be applied to the springs to modify the resonant behavior. For example, damping elements such as lossy foams can be attached to the springs to introduce resistive loss into the vibrations. For example, a sprayable visco-elastic vibration damper can be used to coat the springs in the resonant stack. FIG. 18 is an image of three leaf springs 310 made of bare steel. FIG. 19A is a diagram of an example of a leaf spring 320 that has been spray-coated with a visco-elastic vibration damper material. After spray coating, the spring is completely coated in the visco-elastic vibration damper material. FIG. 19B is a diagram of an example of a leaf spring 322 that has been spray-coated with a visco-elastic vibration damper material 324, in which the clamping locations 326 have been masked during the spray-coat process so that the clamping locations 326 do not have the visco-elastic vibration damper material 324. FIG. 19C is an image of an example of a leaf spring 328 that has been spray-coated with a visco-elastic vibration damper material, in which the clamping locations have been masked during the spray-coat process so that the clamping locations do not have the visco-elastic vibration damper material. Comparing leaf springs 310 (FIG. 18) and 328 (FIG. 19C), it can be seen that at the regions in which the leaf members have been spray-coated with the visco-elastic vibration damper material, the leaf spring 328 is thicker than the leaf spring 310.

In general, any viscoelastic polymer or viscous damper that can be attached in parallel with the spring stack can be used for damping. The damping elements can be selected such that they appropriately reduce the unwanted vibrations with negligible impact to the stiffness of the springs, overall bulk and weight of the resonant stack, and amplitude of the desired resonances. Damping elements having higher damping coefficients can be packaged more efficiently than damping elements having lower damping coefficients.

Figure 20A:
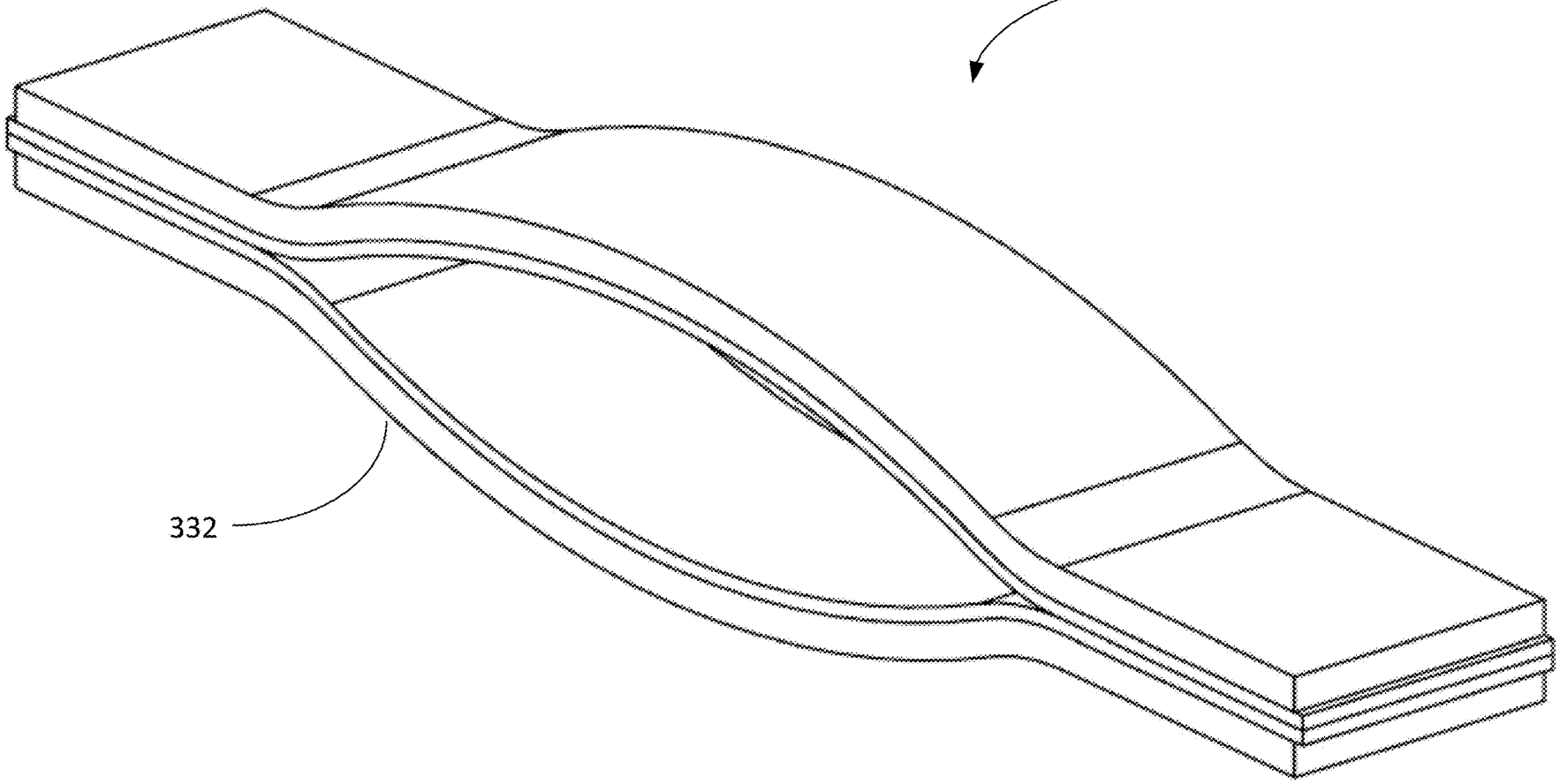
FIGS. 20A and 20B are diagrams of example leaf springs having attached damper members.
Figure 20B:
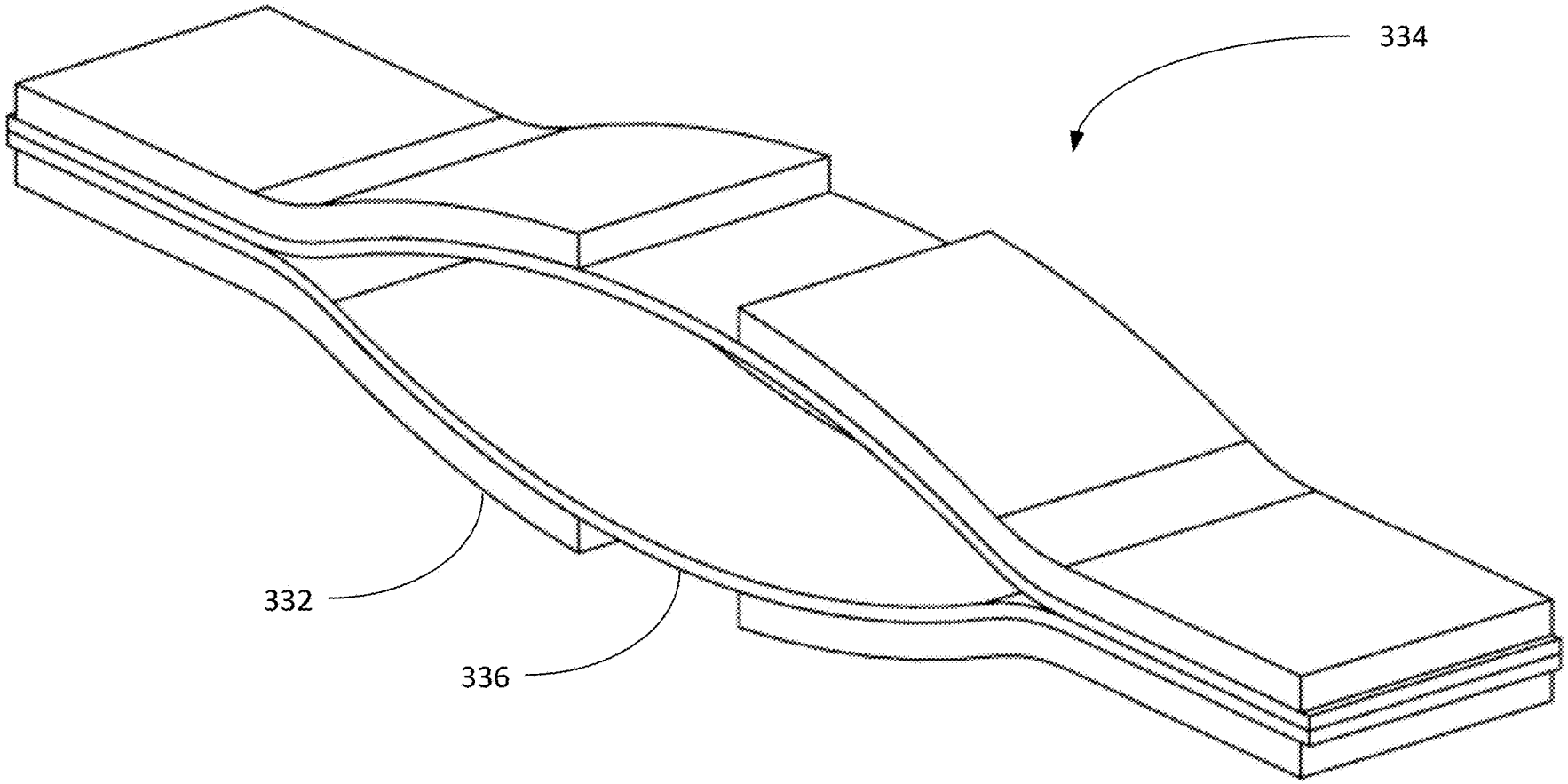
Figure 20C:
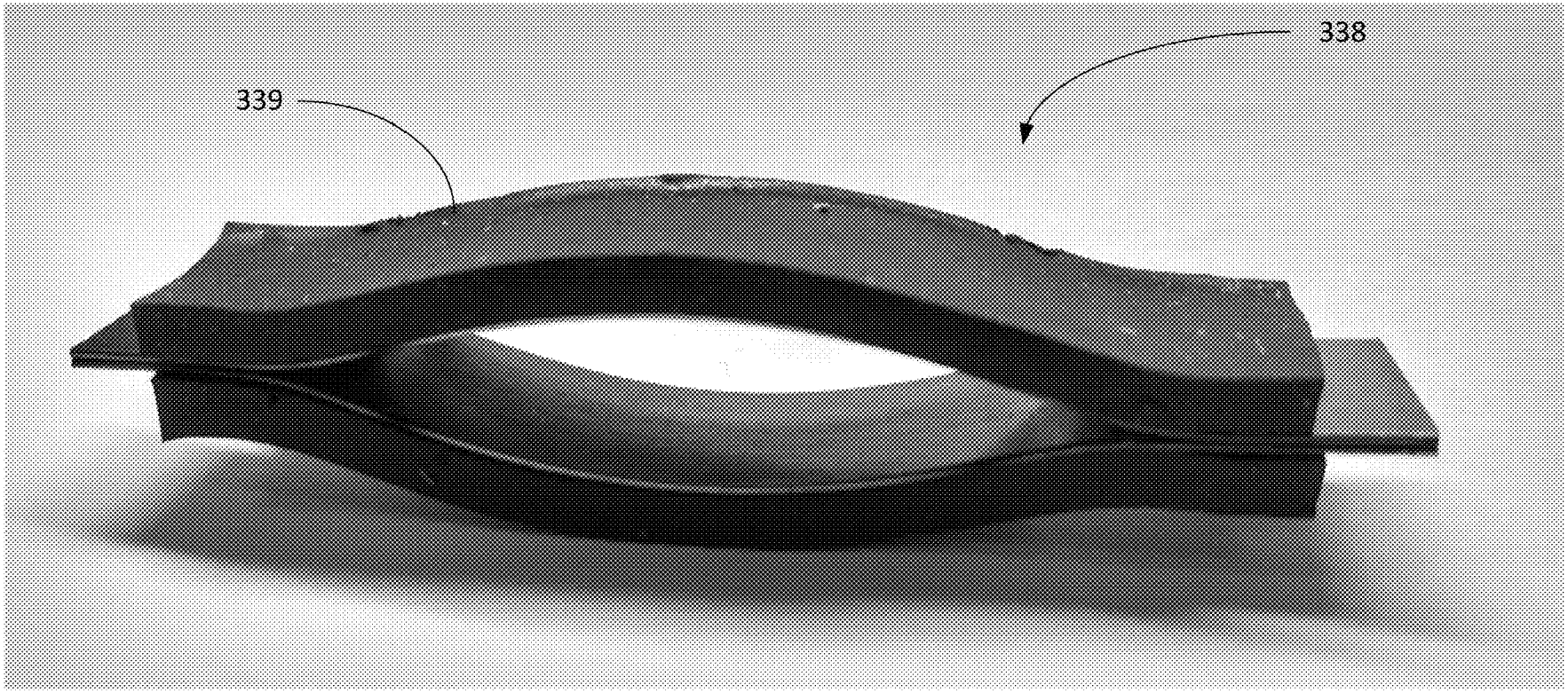
FIG. 20C is an image of an example leaf spring having attached damper members.

For example, visco-elastic polymers can be attached to the springs with a suitable adhesive. FIG. 20A shows an example of a leaf spring 330 in which visco-elastic polymers 332 are attached to the leaf members. FIG. 20B shows an example of a leaf spring 334 in which visco-elastic polymers 332 are attached to the leaf members, except for the clamping areas 336. FIG. 20C shows an image of example of a leaf spring 338 in which visco-elastic polymers 339 are attached to the leaf members. Damping can reduce the overall magnitude of each resonance and smooth out the overall response. Damping can also help suppress higher order resonances that are undesired.

Figure 21:
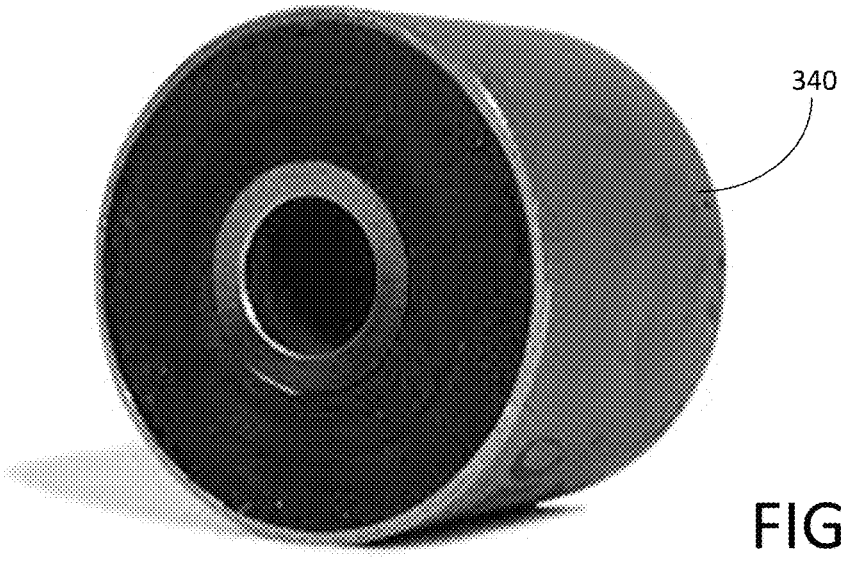
FIG. 21 is an image of an example visco-elastic bushing.
Figure 22:
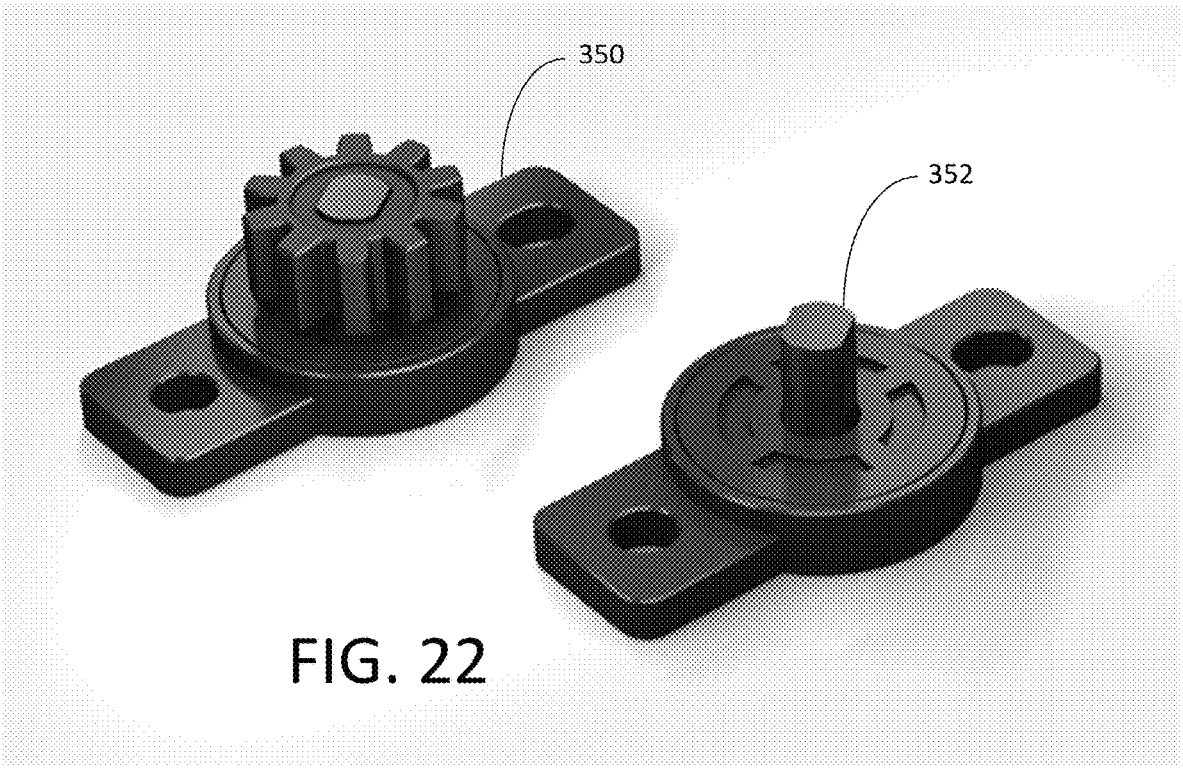
FIG. 22 is an image of examples of rotational viscous dampers

In some implementations, a loss element can be attached directly to the bridge pivot 144 to reduce the unwanted vibrations. For example, referring to FIG. 21, a loss element can include a visco-elastic bushing 340 made from a visco-elastic polymer fixed on the outer diameter and attached to the pivot of the hinge on the inner diameter. For example, referring to FIG. 22, a loss element can be a rotational viscous damper (e.g., 350 and 352) attached to the shaft of the pivot with its case fixed to the body 102 of the guitar 100.

Figure 23:
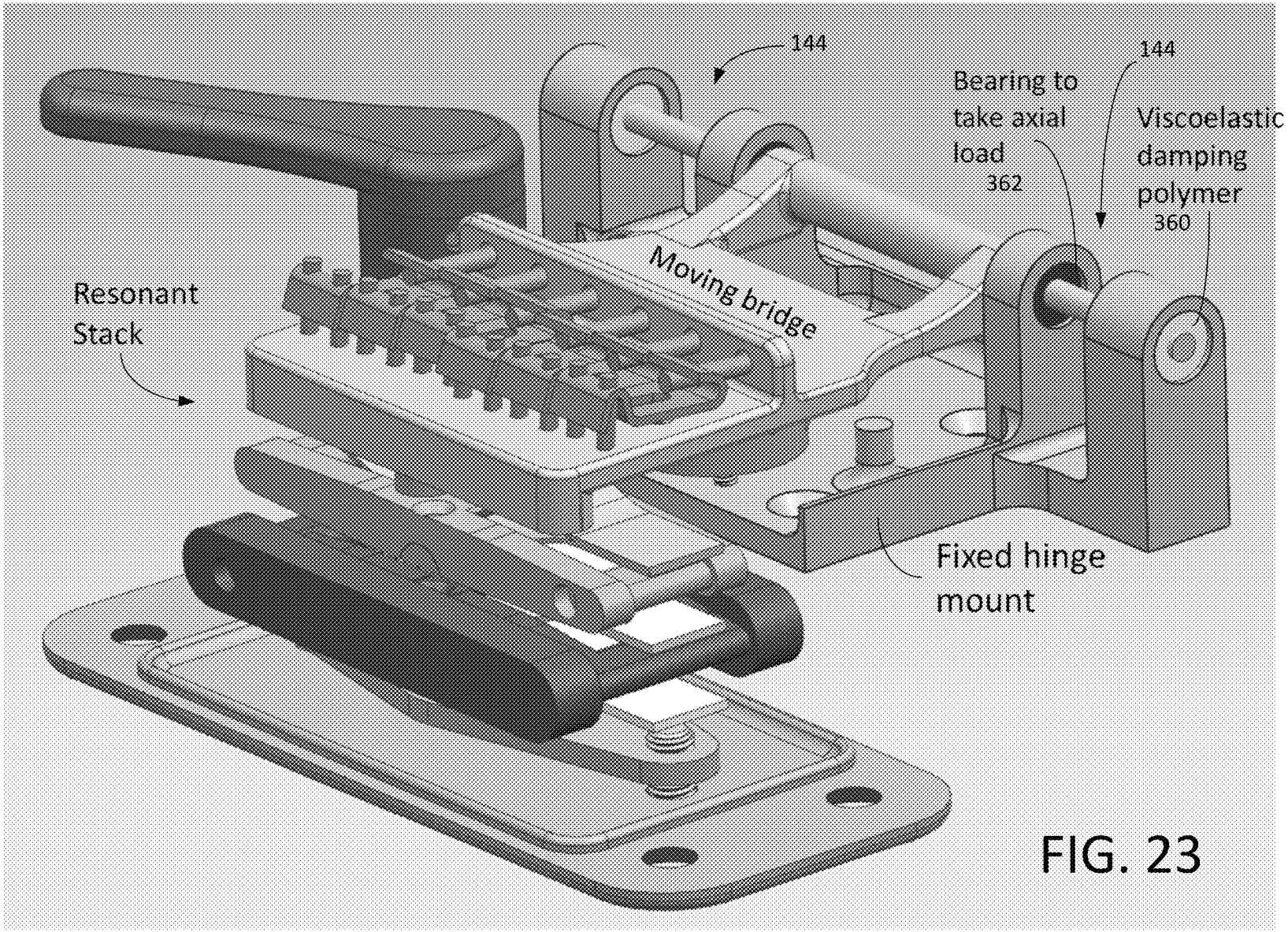
FIG. 23 is a diagram of an example resonant bridge having a loss element inserted into the pivot.

Referring to FIG. 23, for example, a loss element or damper 360 can include a viscoelastic damping polymer that is inserted into the pivot 134. For example, the pivot 134 can include a bearing 362 to support axial load. In some examples, the damper 360 and the bearing 362 are combined or placed side by side to save space. In FIG. 23, the damper 360 and the bearing 362 are shown separately for clarity.

In some implementations, the resonant bridge can include a locking mechanism for locking the resonant bridge in place. Having the locking mechanism is beneficial for at least two reasons. First, it may provide users a better AB test between acoustic sound and feel, and electric sound and feel, to get a better understanding of the differences. Second, the locking mechanism can be used on stage while playing the guitar to quickly switch between styles and sound profiles.

Figure 24A:
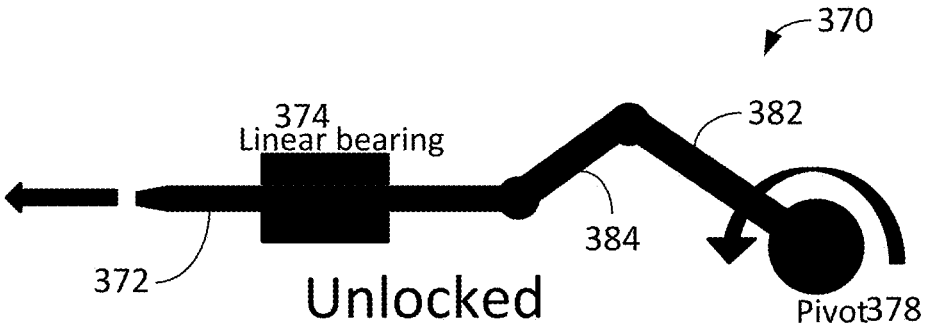
FIGS. 24A and 24B are diagrams showing an example of movable pins in a locking mechanism.
Figure 24B:
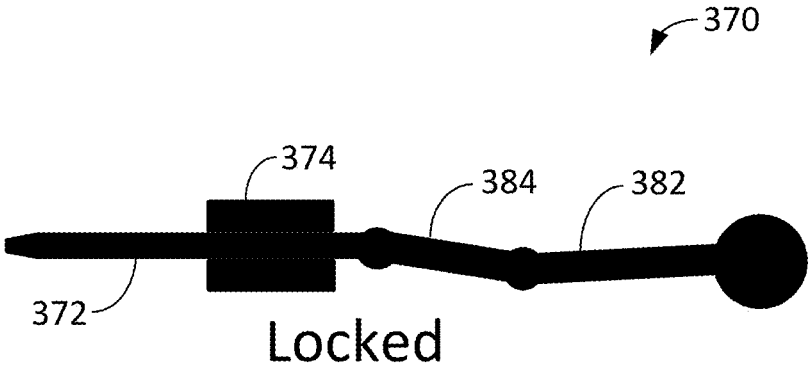

There are many ways to implement the locking mechanism in the resonant bridge system. Referring to FIGS. 24A and 24B, in some implementations, a pin lock 370 can be used to lock the resonant bridge 140 from moving. The pin lock 370 includes two pins 372, each constrained in a linear bearing 374 attached to the body 102 of the guitar 100. The pins 372 can slide into receiving holes on the bridge plate 122. The pins 372 are actuated via a lever arm pivotly coupled (via a pivot 378) to a base member attached to the body 102 of the guitar 100. The lever arm is coupled to a cam arm 382 that is pivotly coupled to a link 384. When the lever arm is rotated, the cam arm 382 swings down and pushes the link 384 out, which in turn pushes the pin 372 towards the hole in the bridge plate 122. The pin lock 370 is designed with a snap through so that once the lever arm is almost fully depressed, it will stay in the locked position.

When unlocking the pin lock 370, the user can pull up on the lever arm to cause the pin 372 to be pulled back and out of the hole in the bridge plate 122. In some examples, springs are provided to constantly push the pins 372 back towards the cam 382. This way, when the lever arm is slightly pulled up, the cam arm 382 and the link 384 will snap into the unlocked position due to the force from the springs. The pin lock 370 is easy to use, and the user can lock or unlock the pins 372 with only a small amount of force. In this example, two pins 372 are used so that the center area of the resonant bridge 140 can be used to accommodate the bridge plate pickup 120. Other configurations can also be used. For example, in some implementations, the bridge plate pickup 120 is not placed at or near the center of the resonant bridge 140. Because the pivot 144 is strong, and the bridge plate 122 is fairly rigid, the displacement at any point along the bridge plate 122 should be about the same. Thus, the bridge plate pickup can be placed at any point along the bridge plate 122.

Figure 25A:
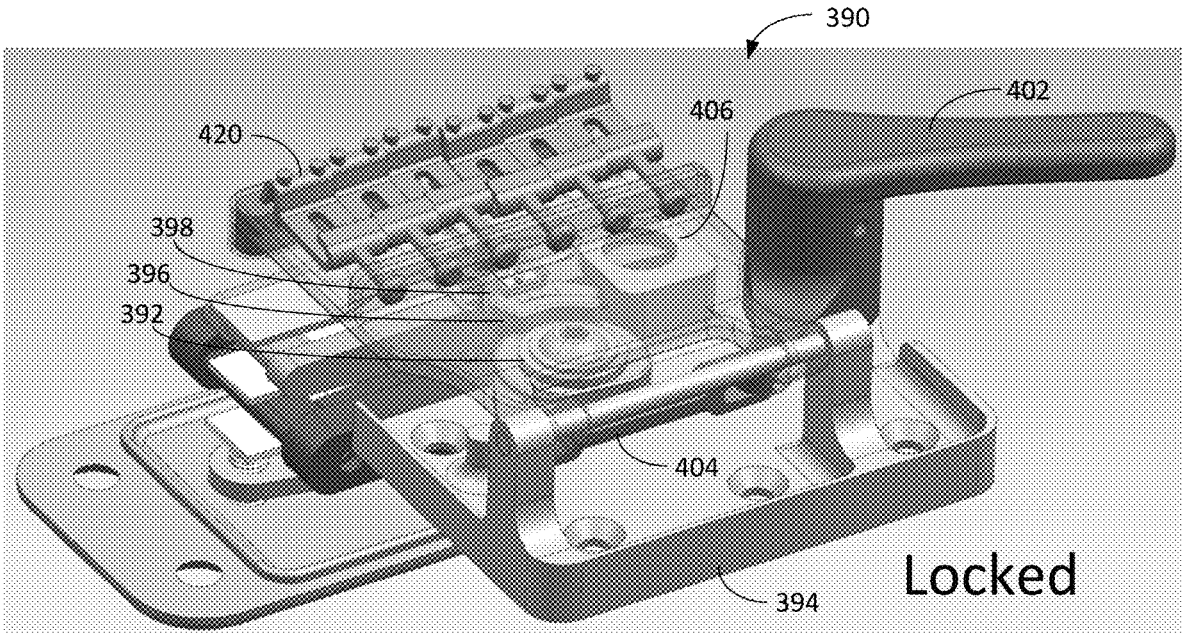
FIGS. 25A and 25B are diagrams of an example window style locking mechanism in a locked position and an unlocked position, respectively.
Figure 25B:
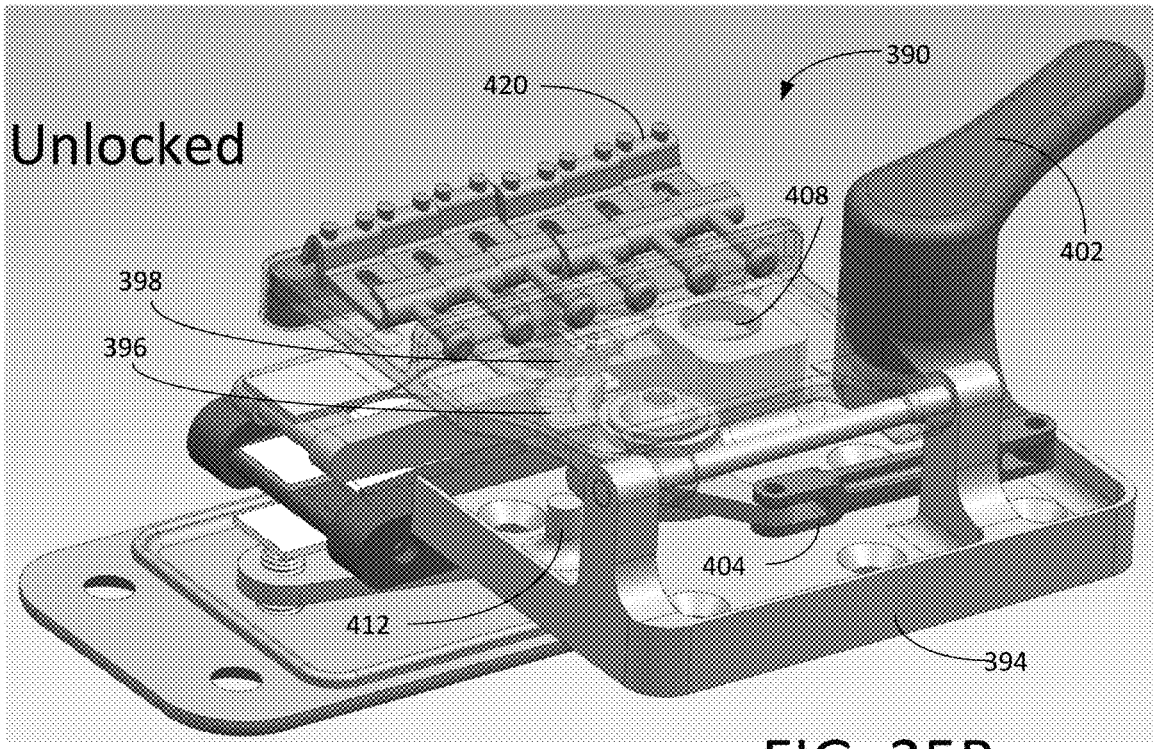

Referring to FIGS. 25A and 25B, in some implementations, a window style locking mechanism 390 is used to lock the resonant bridge 140 and prevent it from moving. In this locking mechanism, a steel lock wheel 392 is mounted to an aluminum mount plate 394 and allowed to spin about its axis. The lock wheel 392 has a tapered finger 396 that, when rotated, engages a lock slot 398 on a bottom side of the bridge plate 122. When the lock wheel 392 is rotated all the way and the finger 396 reaches full width within the lock slot 398, the resonant bridge 140 is effectively locked from any vertical movement.

The lock wheel 392 is linked to a lock lever 402 through a connecting link 404 such that rotation of the lock lever 402 causes the lock wheel 392 to also rotate. Because the lock wheel 392 is located under the resonant bridge 140, the lock lever 402 is positioned to the side so that the lock lever 402 can be conveniently actuated by the user. The connecting link 404 couples the lock wheel 392 and the lock lever 402 together and allows the lock lever 402 to be positioned to the side as shown in FIG. 25A. The mount plate 394 includes a bridge plate pickup mount 406 that has a hole 408 to mount a cylindrical bridge plate pickup (e.g., 120). For example, the bridge plate pickup 120 can be made from a modified electromagnetic buzzer that has a coil. A magnet is mounted on the bridge plate 122 and interacts with the coil in the buzzer to produce the bridge plate pickup signal. For example, there is a spring plunger and accompanying shallow holes on the underside of the lock wheel 392 to give the user some tactile feedback when locking or unlocking the resonant bridge 140. The mount plate 394 can have hard stops (e.g., 412) to prevent the lock wheel 392 and the lock lever 402 from turning past the locked or unlocked position.

FIG. 25A shows the lock wheel 392 in the locked position, in which the finger 396 fully engages the lock slot 398. FIG. 25B shows the lock wheel 392 in the unlocked position, in which the finger 396 is disengaged from the lock slot 398. In some examples, the resonant bridge 140 is made of aluminum, and a plastic insert is used in the lock slot 398 to reduce friction and prevent galling. A user can move the lock lever 402 to the locked position to cause the bridge plate 122 to be locked. The user can move the lock wheel lever 402 to the unlocked position to allow the bridge plate 122 to be unlocked and vibrate at the specified resonant frequencies.

The following describes examples of mechanisms for adjustment of actions. The acoustic guitar action refers to the height of the strings 106 above the fretboard 110. The guitar action is also used to describe the general feel and playability of a guitar. The following describes two examples of ways to adjust the action in the guitar 100. In some implementations, a saddle height adjustment mechanism provides individual saddle height adjustment. Each saddle has a corresponding vertical set screw that can be turned to adjust the height of the saddle up or down.

In some implementations, a height adjustment mechanism is provided to adjust the height of the entire resonant bridge 140. The resonant stack (which includes the masses M1, M2, M3 and the springs C1, C2, C3) is attached on the bottom to an adjustment plate. Adjustment screws are threaded into the adjustment plate and push up against the base plate 164 that is mounted to the body 102 of the guitar 100. As the screws are adjusted, the adjustment plate moves away or towards the base plate 164, which increases or decreases the height of the bridge plate 122.

Figure 26:
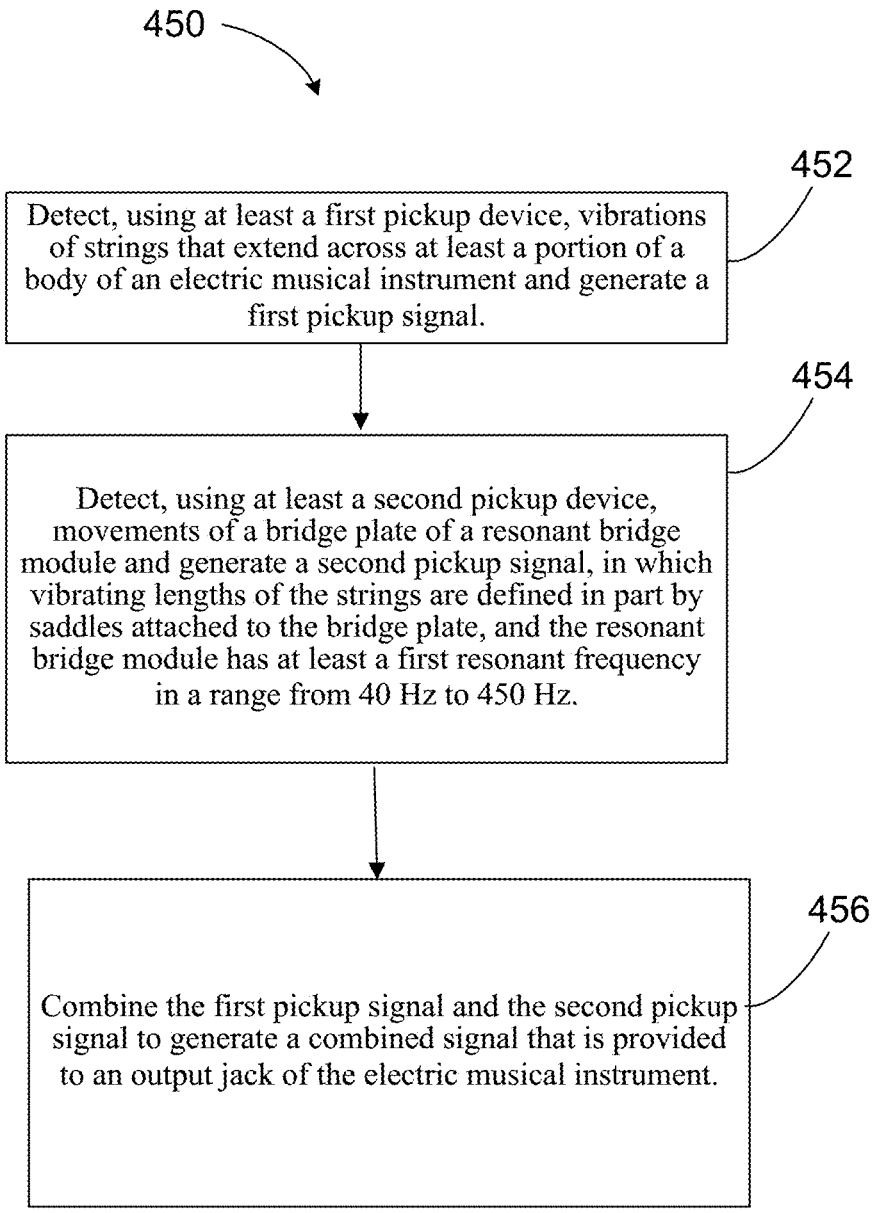
FIG. 26 is a flow diagram of an example process for operating an electric string instrument having a resonant bridge.

Referring to FIG. 26, an example process 450 for operating an electric string instrument having a resonant bridge includes the following steps.

Step 452: Detect, using at least a first pickup device, vibrations of strings that extend across at least a portion of a body of an electric musical instrument and generate a first pickup signal. For example, the first pickup device can include the neck pickup 114, the bridge pickup 116, and/or the middle pickup 118. The strings can include the strings 106. The body can be the body 102, and the electric musical instrument can be the electric guitar 100.

Step 454: Detect, using at least a second pickup device, movements of a bridge plate of a resonant bridge and generate a second pickup signal, in which vibrating lengths of the strings are defined in part by saddles attached to the bridge plate, and the resonant bridge has at least a first resonant frequency in a range from 40 Hz to 450 Hz. For example, the second pickup device can be the bridge plate pickup 120, the bridge plate can be the bridge plate 122, the resonant bridge can be the resonant bridge 140.

Step 456: Combine the first pickup signal and the second pickup signal to generate a combined signal that is provided to an output jack of the electric musical instrument. For example, the output jack can be the output jack 204.

The signal processing in the electric musical instruments described in this document can be controlled, at least in part, using one or more computer program products, e.g., one or more computer programs tangibly embodied in one or more information carriers, such as one or more non-transitory machine-readable media, for execution by, or to control the operation of, one or more data processing apparatus, e.g., a programmable processor, a computer, multiple computers, and/or programmable logic components.

The signal processing associated with the electric musical instruments described in this document can be performed by one or more programmable processors executing one or more computer programs to perform the functions described in this document. A computer program can be written in any form of programming language, including compiled or interpreted languages, and it can be deployed in any form, including as a stand-alone program or as a module, component, subroutine, or other unit suitable for use in a computing environment. Control over all or part of the electric musical instrument described in this document can be implemented using special purpose logic circuitry, e.g., an FPGA (field programmable gate array) and/or an ASIC (application-specific integrated circuit).

The digital signal processor 182 can include one or more processors. Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as hard drives, magnetic disks, magneto-optical disks, or optical disks. Machine-readable storage media suitable for embodying computer program instructions and data include various forms of non-volatile storage area, including by way of example, semiconductor storage devices, e.g., EPROM, EEPROM, and flash storage devices; magnetic disks, e.g., internal hard disks or removable disks; magneto-optical disks; and CD-ROM and DVD-ROM discs.

The processes for processing pickup signals described above can be implemented using software for execution on one or more mobile computing devices, and/or one or more remote computing devices. For instance, the software forms procedures in one or more computer programs that execute on one or more programmed or programmable computer systems, either in the mobile computing devices, or remote computing systems (which may be of various architectures such as distributed, client/server, or grid), each including at least one processor, at least one data storage system (including volatile and non-volatile memory and/or storage elements), at least one wired or wireless input device or port, and at least one wired or wireless output device or port. The software may form one or more modules of a larger program, for example, that provides other services related to managing the operations of a home, such as cleaning sessions and security monitoring of the home.

The software may be provided on a medium, such as a CD-ROM, DVD-ROM, or Blu-ray disc, readable by a general or special purpose programmable computer or delivered (encoded in a propagated signal) over a network to the computer where it is executed. The functions may be performed on a special purpose computer, or using special-purpose hardware, such as coprocessors. The software may be implemented in a distributed manner in which different parts of the computation specified by the software are performed by different computers. Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the description have been described. Nevertheless, it will be understood that various modifications may be made without departing from the spirit and scope of the description. For example, the spring components of the resonant bridge can be made of a material different from those described above. For example, the springs can be made of various types of metals or alloys. The springs can be made of a composite material, such as fiberglass and epoxy laminate, or heavy metal filled thermoplastic (e.g., tungsten filled nylon). The springs can be made of wood, such as bamboo. The spring components can be designed and/or configured in ways different from those described above. The mass components can be designed and/or configured in ways different from those described above. Some of the steps described above may be order independent, and thus can be performed in an order different from that described. It is to be understood that the foregoing description is intended to illustrate and not to limit the scope of the invention, which is defined by the scope of the appended claims.

Although the present invention is defined in the attached claims, it should be understood that the present invention can also be defined in accordance with the following embodiments:

Embodiment 1

An electric musical instrument comprising:

a body;

a fingerboard;

a nut;

a resonant bridge module comprising a bridge plate, a first spring, a second mass, and a second spring, the bridge plate having a bridge plate mass, the first spring having a first spring constant, the second spring having a second spring constant, in which the resonant bridge module has at least a first resonant frequency and a second resonant frequency that are dependent on the bridge plate mass, the first spring constant, the first mass, and the second spring constant;

a plurality of strings extending from the nut to the bridge plate across at least a portion of the fingerboard and at least a portion of the body, in which the nut and the bridge define vibrating lengths of the strings;

at least a first pickup device to detect vibrations of the strings and generate a first pickup signal; and at least a second pickup device to detect movements of the bridge and generate a second pickup signal.

Embodiment 2

The electric musical instrument of embodiment 1, comprising a locking mechanism having a first operational state and a second operational state, in which in the first operational state the locking mechanism is configured to lock the resonant bridge module to suppress oscillations of the bridge plate, and in the second operational state the locking mechanism does not suppress the oscillations of the bridge plate.

Embodiment 3

The electric musical instrument of embodiment 2 in which the locking mechanism comprises a lever and at least one pin, the bridge plate defines at least one hole, the lever is configured to be movable between a first position and a second position, and the locking mechanism is configured such that moving the lever to the first position causes the at least one pin to engage the at least one hole to prevent oscillations of the bridge plate, and moving the lever to the second position causes the at least one pin to disengage from the at least one hole to allow the bridge plate to oscillate when excited by vibrations of the strings.

Embodiment 4

The electric musical instrument of embodiment 2 in which the locking mechanism comprises a window style locking mechanism having a lock wheel having a finger, the bridge plate has a slot, the lock wheel is rotatable between a first position and a second position and configured such that when the lock wheel rotates to the first position, the finger of the lock wheel engages the slot of the bridge plate and prevents oscillations of the bridge plate, and when the lock wheel rotates to the second position, the finger of the lock wheel disengages from the slot of the bridge plate to enable the bridge plate to oscillate when excited by vibrations of the strings.

Embodiment 5

The electric musical instrument of any of embodiments 1 to 4 in which a center of mass of the first spring is disposed between a center of mass of the bridge plate and a center of mass of the second mass, and a center of mass of the second spring is disposed between a center of mass of the second mass and the body of the electrical musical instrument.

Embodiment 6

The electric musical instrument of any of embodiments 1 to 5 in which the bridge plate is directly or indirectly coupled to the second mass through the first spring, and the second mass is directly or indirectly coupled to the body through the second spring.

Embodiment 7

The electric musical instrument of any of embodiments 1 to 6 in which the bridge plate, the first spring, and the second mass are configured such that when the bridge plate vibrates, at least a portion of the vibration of the bridge plate is transmitted to the second mass through the first spring.

Embodiment 8

The electric musical instrument of any of embodiments 1 to 7, comprising an electronic circuit configured to combine the first pickup signal with the second pickup signal to generate a combined output signal.

Embodiment 9

The electric musical instrument of any of embodiments 1 to 8, comprising:

an electronic circuit to process at least one of the first pickup signal or the second pickup signal; and a switch that is configured to select between a first mode and a second mode, in which when the first mode is selected, the electronic circuit is configured to combine the first pickup signal and the second pickup signal to generate a combined output signal that is provided to an output jack of the electric musical instrument, and when the second mode is selected, the electronic circuit is configured to provide the first pickup signal to the output jack.

Embodiment 10

The electric musical instrument of embodiment 11 in which the first pickup signal is configured to have sound characteristics that resemble those of a conventional electric guitar, and the mixed output signal is configured to have sound characteristics that more closely resemble those of a conventional acoustic guitar.

Embodiment 11

The electric musical instrument of embodiment 12 in which the first and second resonant frequencies correspond to resonant frequencies of the acoustic guitar defined by at least one of top and bottom decks of the acoustic guitar, an acoustic volume of the acoustic guitar, or a sound hole dimension of the acoustic guitar.

Embodiment 12

The electric musical instrument of any of embodiments 1 to 11 in which the first and second resonant frequencies are in a range between 40 Hz to 450 Hz.

Embodiment 13

The electric musical instrument of any of embodiments 1 to 12 in which the first and second resonant frequencies are configured to substantially match natural resonant frequencies of a specific acoustic guitar.

Embodiment 14

The electric musical instrument of any of embodiments 1 to 13 in which a first portion of the bridge plate is pivotly coupled to the body, or pivotly coupled to a hinge coupled to the body, a second portion of the bridge plate is coupled to the first spring, and the nut and saddles coupled to the second portion of the bridge plate define the vibrating lengths of the strings.

Embodiment 15

The electric musical instrument of any of embodiments 1 to 14 in which the resonant bridge module further comprises a second object and a third spring, the second object has a second mass, the third spring has a third spring constant, the resonant bridge module has at least a first resonant frequency, a second resonant frequency, and a third resonant frequency that are dependent on the bridge plate mass, the first spring constant, the first mass, the third spring constant, the second mass, and the second spring constant.

Embodiment 16

The electric musical instrument of embodiment 15 in which a center of mass of the third spring is disposed between a center of mass of the second mass and a center of mass of the second object, and a center of mass of the second spring is disposed between a center of mass of the second object and the body.

Embodiment 17

The electric musical instrument of embodiment 15 or 16 in which the bridge plate is directly or indirectly coupled to the second mass through the first spring, the second mass is directly or indirectly coupled to the second object through the third spring, and the second object is directly or indirectly coupled to the body through the second spring.

Embodiment 18

The electric musical instrument of any of embodiments 15 to 17 in which the bridge plate, the first spring, the second mass, the third spring, and the second object are configured such that when the bridge plate vibrates, at least a portion of the vibration of the bridge plate is transmitted to the second mass through the first spring, and when the second mass vibrates, at least a portion of the vibration of the second mass is transmitted to the second object through the third spring.

Embodiment 19

The electric musical instrument of any of embodiments 15 to 18 in which the second mass is configured to clamp the first spring to the second spring, and the second object is configured to clamp the second spring to the third spring.

Embodiment 20

The electric musical instrument of any of embodiments 15 to 19 in which the first mass is smaller than the second mass.

Embodiment 21

The electric musical instrument of any of embodiments 15 to 20 in which the first spring constant is larger than the third spring constant.

Embodiment 22

The electric musical instrument of any of embodiments 15 to 21 in which the third spring constant is larger than the second spring constant.

Embodiment 23

The electric musical instrument of any of embodiments 15 to 22 in which the first spring constant, the third spring constant, and the second spring constant are the same.

Embodiment 24

The electric musical instrument of any of embodiments 15 to 23 in which the resonant bridge module is coupled to an upper surface of the body, and the first spring, the second mass, and the third spring are configured such that the second mass primarily oscillates along directions substantially orthogonal to the upper surface of the body.

Embodiment 25

The electric musical instrument of embodiment 24 in which the third spring, the second object, and the second spring are configured such that the second object primarily oscillates along directions substantially orthogonal to the upper surface of the body.

Embodiment 26

The electric musical instrument of any of embodiments 15 to 25 in which each of the first spring constant, the second spring constant, and the third spring constant is in a range between 20,000 N/m to 100,000 N/m.

Embodiment 27

The electric musical instrument of any of embodiments 15 to 26 in which each of the first mass and the second mass is in a range between 20 grams to 300 grams.

Embodiment 28

The electric musical instrument of any of embodiments 15 to 27 in which the bridge plate, the first spring, the second mass, the third spring, the second object, and the second spring are configured such that each of the bridge plate, the second mass, and the second object has a single degree of freedom.

Embodiment 29

The electric musical instrument of any of embodiments 15 to 28 in which each of the second mass and the second object comprises at least one of steel, brass, copper, plastic, glass, or a composite material.

Embodiment 30

The electric musical instrument of any of embodiments 1 to 29 in which the second mass comprises at least one of steel, brass, or copper.

Embodiment 31

The electric musical instrument of any of embodiments 1 to 30 in which the second mass comprises at least one of plastic, glass, or a composite material.

Embodiment 32

The electric musical instrument of any of embodiments 1 to 31 in which each of the first spring constant and the second spring constant is in a range between 20,000 N/m to 100,000 N/m.

Embodiment 33

The electric musical instrument of any of embodiments 15 to 32 in which each of the first mass and the second mass is in a range between 20 grams to 300 grams.

Embodiment 34

The electric musical instrument of any of embodiments 1 to 33 in which the first spring constant is larger than the second spring constant.

Embodiment 35

The electric musical instrument of any of embodiments 1 to 34 in which the first spring constant and the second spring constant are the same.

Embodiment 36

The electric musical instrument of any of embodiments 1 to 35 in which the bridge, the first spring, the second mass, and the second spring are configured such that each of the bridge and the second mass has a single degree of freedom.

Embodiment 37

The electric musical instrument of any of embodiments 1 to 36 in which the resonant bridge module comprises a first damping material applied to at least one of the first spring or the second spring.

Embodiment 38

The electric musical instrument of embodiment 20 in which the first damping material is configured to reduce a higher order resonance of the resonant bridge module.

Embodiment 39

The electric musical instrument of any of embodiments 1 to 38 in which the first spring comprises a leaf-style spring having a first leaf member and a second leaf member, a first end of the first leaf member is attached to a first end of the second leaf member, a second end of the first leaf member is attached to a second end of the second leaf member, and a middle portion of the first leaf member is spaced apart from a middle portion of the second leaf member to form an opening between the first and second leaf members.

Embodiment 40

The electric musical instrument of embodiment 39 in which the bridge plate comprises a portion that clamps the first leaf member, and the second mass comprises a portion that clamps the second leaf member, and at least a first portion of the first leaf member is movable relative to at least a first portion of the second leaf member to enable the bridge to move relative to the second mass.

Embodiment 41

The electric musical instrument of embodiment 39 or 40 in which the bridge plate or a clamp member coupled to the bridge plate has a first portion that passes through the opening between the first and second leaf members, and the second mass or a clamp member coupled to the second mass has a first portion that passes through the opening between the first and second leaf members.

Embodiment 42

The electric musical instrument of any of embodiments 39 to 41 in which the second spring comprises a leaf-style spring having a first leaf member and a second leaf member, the second mass comprises a first portion and a second portion, the second mass is configured to clamp the second leaf member of the first spring and the first leaf member of the second spring together, the first portion of the second mass is configured to press against a middle portion of the second leaf member of the first spring in a first direction, and the second portion of the second mass is configured to press against a middle portion of the first leaf member of the second spring in a second direction opposite to the first direction.

Embodiment 43

The electric musical instrument of any of embodiments 39 to 42 in which each of the first and second leaf members comprises a flexible rectangular metal member.

Embodiment 44

The electric musical instrument of any of embodiments 1 to 43 in which the second mass is configured to clamp the first spring to the second spring.

Embodiment 45

The electric musical instrument of any of embodiments 1 to 44 in which the first spring comprises a compression spring having a coil member.

Embodiment 46

The electric musical instrument of any of embodiments 1 to 44 in which the first spring comprises a metal machined helical spring.

Embodiment 47

The electric musical instrument of any of embodiments 1 to 44 in which the first spring comprises a metal wave style spring having flexible wave-shape members, portions of the flexible wave-shape members are attached to each other, openings are formed between the flexible wave-shape members, and the metal wave style spring is configured to be compressible by reducing the sizes of the openings between the flexible wave-shape members.

Embodiment 48

The electric musical instrument of any of embodiments 1 to 44 in which the first spring comprises an elastomer spring.

Embodiment 49

The electric musical instrument of any of embodiments 1 to 44 in which the first spring comprises an air spring having an elastic bladder that holds an amount of air sealed inside the elastic bladder.

Embodiment 50

The electric musical instrument of any of embodiments 1 to 49 in which the second spring is attached to an adjustment plate, the adjustment plate is coupled to the musical instrument body through an adjustment mechanism that enables adjustment of a distance between the adjustment plate and the musical instrument body, and a change in the distance between the adjustment plate and the musical instrument body results in a change in a distance between the bridge plate and the musical instrument body.

Embodiment 51

The electric musical instrument of embodiment 50 in which the adjustment mechanism comprises at least one screw, the adjustment mechanism is configured such that the distance between the adjustment plate and the musical instrument body can be modified by turning the at least one screw.

Embodiment 52

The electric musical instrument of any of embodiments 1 to 51 in which the second pickup device comprises at least one of a magnetic sensor or an optical sensor.

Embodiment 53

The electric musical instrument of any of embodiments 1 to 52, comprising a digital signal processor configured to process at least one of the first pickup signal or the second pickup signal by applying a selected frequency response curve to the pickup signal, in which the selected frequency response is selected from a plurality of pre-stored frequency response curves.

Embodiment 54

The electric musical instrument of embodiment 53 in which each of the plurality of frequency response curves is configured to enable the digital signal processor to modify the pickup signal to mimic a particular guitar or a particular group of guitars.

Embodiment 55

The electric musical instrument of embodiment 53 or 54, comprising:

a storage device configured to store data representing the frequency response curves, and a communication module configured to communicate with a computing device to enable downloading the data representing the frequency response curves from the computing device.

Embodiment 56

The electric musical instrument of any of embodiments 1 to 55 in which the electric musical instrument comprises at least one of an electric guitar, an electric bass guitar, an electric violin, an electric viola, an electric cello, an electric double bass, an electric banjo, an electric mandolin, or an electric ukulele.

Embodiment 57

The electric musical instrument of any of embodiments 1 to 56 in which at least one of the first spring or the second spring has an adjustable spring constant.

Embodiment 58

The electric musical instrument of embodiment 57, comprising a controller configured to control the adjustable spring constant to adjust at least one of the first resonant frequency or the second resonant frequency.

Embodiment 59

The electric musical instrument of any of embodiments 1 to 58, comprising one or more weights that are magnetically coupled to at least one of the bridge plate or the second mass to adjust at least one of the first resonant frequency or the second resonant frequency.

Embodiment 60

The electric musical instrument of any of embodiments 1 to 59 in which the resonant bridge module is configured to cover less than 10 square inches of a surface area of the body.

Embodiment 61

The electric musical instrument of any of embodiments 1 to 60 in which the electric musical instrument is configured to output a specified maximum unamplified audio level when the strings are strummed, and the resonant bridge module is configured to produce no sound or a sound that is no more than 10 dBA without electric amplification when the electric musical instrument outputs the specified maximum unamplified audio level.

Embodiment 62

An electric musical instrument comprising:

a body;

a resonant stack comprising a bridge having a bridge mass and at least a first spring having a first spring constant, in which the first spring is disposed between the bridge and the body, and the resonant stack has at least one resonant frequency that is dependent on the bridge mass and the first spring constant;

a plurality of strings that extend across at least a portion of the body, in which each string has a vibrating length defined at least in part by the bridge;

at least a first pickup device to detect vibrations of the strings and generate a first pickup signal; and at least a second pickup device to detect movements of the bridge and generate a second pickup signal.

Embodiment 63

An electric musical instrument comprising:

a body;

a floating bridge having a first portion pivotly coupled to the body or pivotly coupled to a hinge attached to the body, in which the floating bridge has a second section resonantly coupled to the body through at least a first spring, and the floating bridge is configured to have at least a first natural resonant frequency in a range from 40 Hz to 450 Hz;

a plurality of strings that extend across at least a portion of the body, in which each string has a vibrating length defined at least in part by the floating bridge; and a first pickup device configured to detect movements of the bridge and generate a first pickup signal.

Embodiment 64

The electric musical instrument of embodiment 63 in which the first spring comprises a leaf-style spring having a first leaf member and a second leaf member, a first end of the first leaf member is attached to a first end of the second leaf member, a second end of the first leaf member is attached to a second end of the second leaf member, and a middle portion of the first leaf member is spaced apart from a middle portion of the second leaf member to form an opening between the first and second leaf members.

Embodiment 65

An electric musical instrument comprising:

a body;

a resonant bridge module comprising a bridge and at least a first spring, in which the bridge and the at least a first spring are configured to enable the bridge to oscillate at least a first resonant frequency in a range from 40 Hz to 450 Hz;

a plurality of strings that extend across at least a portion of the body, in which each string has a vibrating length defined at least in part by the bridge, and the resonant bridge module is configured to enable the bridge to oscillate upon being excited by vibrations of one or more of the strings;

at least a first pickup device configured to detect vibrations of the strings and generate a first pickup signal;

at least a second pickup device configured to detect movements of the bridge and generate a second pickup signal; and an electronic circuit configured to combine the first pickup signal and the second pickup signal to generate a combined signal that is provided to an output jack of the electric musical instrument.

Embodiment 66

The electric musical instrument of embodiment 65 in which the resonant bridge module is configured such that the bridge has a single degree of freedom.

Embodiment 67

A resonant bridge module for use in an electric musical instrument, the resonant bridge module comprising:

a bridge, at least a first spring, and a base plate, in which the base plate is configured to be attached to a body of the electric musical instrument, the bridge has a bridge mass, the first spring has a first spring constant, and the bridge mass and the first spring constant are selected such that the resonant bridge module has at least a first resonant frequency in a range from 40 Hz to 450 Hz;

wherein the bridge comprises components for receiving a plurality of strings that extend across at least a portion of a body of the electric musical instrument, in which each string has a vibrating length defined at least in part by the bridge.

Embodiment 68

The resonant bridge module of embodiment 67, comprising a locking mechanism having a first state and a second state, in which in the first state the locking mechanism is configured to lock the resonant bridge module to suppress oscillations of the bridge, and in the second state the lock mechanism does not suppress the oscillations of the bridge.

Embodiment 69

The resonant bridge module of embodiment 67 or 68 in which a center of mass of the first spring is disposed between a center of mass of the bridge and the plate.

Embodiment 70

The resonant bridge module of any of embodiments 67 to 69 in which the bridge is directly or indirectly coupled to the body through the first spring.

Embodiment 71

The resonant bridge module of any of embodiments 67 to 70 in which the bridge and the first spring are configured such that when the bridge vibrates, at least a portion of the vibration of the bridge is transmitted to the first spring.

Embodiment 72

The resonant bridge module of any of embodiments 67 to 71, comprising a magnet attached to the bridge at a position that is configured to enable a first pickup device of the electric musical instrument to detect movements of the bridge by detecting movements of the magnet.

Embodiment 73

The resonant bridge module of any of embodiments 67 to 72, comprising a second mass and a second spring, in which the second spring has a second spring constant, the resonant bridge module has at least a first resonant frequency and a second resonant frequency that are dependent on the bridge mass, the first spring constant, the first mass, and the second spring constant.

Embodiment 74

The resonant bridge module of embodiment 73 in which a center of mass of the first spring is disposed between a center of mass of the bridge and a center of mass of the second mass, and a center of mass of the second spring is disposed between a center of mass of the second mass and the body.

Embodiment 75

The resonant bridge module of embodiment 73 or 74 in which the bridge is directly or indirectly coupled to the second mass through the first spring, and the second mass is directly or indirectly coupled to the body through the second spring.

Embodiment 76

The resonant bridge module of any of embodiments 73 to 75 in which the bridge and the first spring are configured such that when the bridge vibrates, at least a portion of the vibration of the bridge is transmitted to the second mass through the first spring.

Embodiment 77

The resonant bridge module of any of embodiments 73 to 76, comprising a second object and a third spring, the second object has a second mass, the third spring has a third spring constant, the resonant bridge module has at least a first resonant frequency, a second resonant frequency, and a third resonant frequency that are dependent on the bridge mass, the first spring constant, the first mass, the third spring constant, the second mass, and the second spring constant.

Embodiment 78

The resonant bridge module of embodiment 77 in which a center of mass of the third spring is disposed between a center of mass of the second mass and a center of mass of the second object, and a center of mass of the second spring is disposed between a center of mass of the second object and the body.

Embodiment 79

The resonant bridge module of any of embodiments 73 to 78 in which the bridge is directly or indirectly coupled to the second mass through the first spring, the second mass is directly or indirectly coupled to the second object through the third spring, and the second object is directly or indirectly coupled to the body through the second spring.

Embodiment 80

The resonant bridge module of any of embodiments 73 to 79 in which the bridge, the first spring, the second mass, the third spring, and the second object are configured such that when the bridge vibrates, at least a portion of the vibration of the bridge is transmitted to the second mass through the first spring, and when the second mass vibrates, at least a portion of the vibration of the second mass is transmitted to the second object through the third spring.

Embodiment 81

The resonant bridge module of any of embodiments 67 to 80, comprising a hinge, in which a first portion of the bridge is pivotly coupled to a first portion of the hinge, a second portion of the hinge is configured to be coupled to the body of the electric musical instrument, and a second portion of the bridge is coupled to the first spring.

Embodiment 82

The resonant bridge module of any of embodiments 67 to 81, comprising an adjustment plate, in which the first spring or another spring is attached to the adjustment plate, the adjustment plate is coupled to the base plate through an adjustment mechanism that enables adjustment of a distance between the adjustment plate and the base plate, and a change in the distance between the adjustment plate and the base plate results in a change in a distance between the bridge and the base plate.

Embodiment 83

A method comprising:

detecting, using at least a first pickup device, vibrations of strings that extend across at least a portion of a body of an electric musical instrument and generate a first pickup signal;

detecting, using at least a second pickup device, movements of a bridge plate of a resonant bridge and generate a second pickup signal, in which vibrating lengths of the strings are defined in part by the resonant bridge, and the resonant bridge has at least a first resonant frequency in a range from 40 Hz to 450 Hz; and combining the first pickup signal and the second pickup signal to generate a combined signal that is provided to an output jack of the electric musical instrument.

Embodiment 84

The method of embodiment 83, comprising enabling user selection between an electric guitar mode and an acoustic guitar mode, wherein upon user selection of the acoustic guitar mode, allowing vibrations of the bridge plate in response to vibrations of the strings, and wherein upon user selection of the electric guitar mode, suppressing the vibrations of the bridge plate.

Embodiment 85

The method of embodiment 83 or 84, comprising enabling user selection between a first operational mode and a second operation mode, upon user selection of the first operational mode, locking the resonant bridge to suppress oscillations of the bridge plate, and upon user selection of the second operational mode, unlocking the resonant bridge and not suppress the oscillations of the bridge plate.

Embodiment 86

The method of embodiment 85, in which locking the resonant bridge comprises moving at least one pin to engage at least one hole defined by the bridge plate to prevent oscillations of the bridge plate, and unlocking the resonant bridge comprises disengaging the at least one pin from the at least one hole to allow the bridge plate to oscillate when excited by vibrations of the strings.

Embodiment 87

The method of embodiment 85, in which locking the resonant bridge comprises rotating a lock wheel having a finger to a first position to cause the finger to engage a slot defined by the bridge plate to prevent oscillations of the bridge plate, and unlocking the resonant bridge comprises rotating the lock wheel to a second position to cause the finger of the lock wheel to disengage from the slot defined by the bridge plate to enable the bridge plate to oscillate when excited by vibrations of the strings.

Embodiment 88

The method of any of embodiments 83 to 87 in which the resonant bridge comprises the bridge plate, a first spring, a second mass, and a second spring, the bridge plate has a bridge plate mass, the first spring has a first spring constant, the second spring has a second spring constant, wherein the method comprises vibrating one or more of the strings to cause the bridge plate to oscillate such that the second pickup signal has a frequency spectrum having a first peak at the first resonant frequency and a second peak at the second resonant frequency, wherein the first resonant frequency and the second resonant frequency are dependent on the bridge plate mass, the first spring constant, the first mass, and the second spring constant.

Embodiment 89

The method of any of embodiments 83 to 88, comprising processing the second pickup signal by applying a selected frequency response curve to the second pickup signal, in which the selected frequency response is selected from a plurality of pre-stored frequency response curves.

Embodiment 90

The method of embodiment 89 in which each of the plurality of frequency response curves is configured to enable the second pickup signal to be modified to cause the combined signal to have resonant frequency components that mimic the resonant frequency components of a particular guitar or a particular group of guitars.

Embodiment 91

The embodiment of embodiment 89 or 90, comprising communicating, through a communication module, with a computing device and downloading data representing the frequency response curves from the computing device, and storing, at a storage device, the downloaded data representing the frequency response curves.

Embodiment 92

The embodiment of any of embodiments 83 to 91 in which the electric musical instrument comprises at least one of an electric guitar, an electric bass guitar, an electric violin, an electric viola, an electric cello, an electric double bass, an electric banjo, an electric mandolin, or an electric ukulele.

Embodiment 93

A system comprising:

a first mass;

a first spring having a first leaf member and a second leaf member, in which a first end of the first leaf member is attached to a first end of the second leaf member, a second end of the first leaf member is attached to a second end of the second leaf member, and a middle portion of the first leaf member is spaced apart from a middle portion of the second leaf member to form a first space between the first and second leaf members;

a second left spring having a third leaf member and a fourth leaf member, in which a first end of the third leaf member is attached to a first end of the fourth leaf member, a second end of the third leaf member is attached to a second end of the fourth leaf member, and a middle portion of the third leaf member is spaced apart from a middle portion of the fourth leaf member to form a second space between the third and fourth leaf members;

wherein the first mass comprises a first clamp member and a second clamp member that in combination clamp a portion of the second leaf member to a portion of the third leaf member;

wherein the first clamp member extends into the first space, and the second clamp member extends into the second space; and wherein the first mass comprises at least one mass component that is positioned outside of the first and second spaces.

Embodiment 94

The system of embodiment 93, comprising:

a second mass;

a third spring having a fifth leaf member and a sixth leaf member, in which a first end of the fifth leaf member is attached to a first end of the sixth leaf member, a second end of the fifth leaf member is attached to a second end of the sixth leaf member, and a middle portion of the fifth leaf member is spaced apart from a middle portion of the sixth leaf member to form a third space between the fifth and sixth leaf members;

wherein the second mass comprises a third clamp member and a fourth clamp member that in combination clamp a portion of the fourth leaf member to a portion of the fifth leaf member;

wherein the third clamp member extends into the second space, and the fourth clamp member extends into the third space; and wherein the second mass comprises at least one mass component that is positioned outside of the second and third spaces.

Embodiment 95

The system of embodiment 93 or 94, wherein each of the first, second, third, and fourth leaf members comprises an arched metal plate.

Embodiment 96

The system of embodiment 94 or 95, wherein each of the fifth and sixth second leaf members comprises an arched metal plate.

Embodiment 97

The system of any of embodiments 94 to 96, wherein each of the leaf members comprises a flexible rectangular metal member.

What is claimed is:

1. An electric musical instrument comprising:

a body;

a resonant stack comprising a bridge having a bridge mass and at least a first spring having a first spring constant, in which the first spring is disposed between the bridge and the body, and the resonant stack has at least one resonant frequency that is dependent on the bridge mass and the first spring constant;

a plurality of strings that extend across at least a portion of the body, in which each string has a vibrating length defined at least in part by the bridge;

at least a first pickup device to detect vibrations of the strings and generate a first pickup signal; and at least a second pickup device to detect movements of the bridge and generate a second pickup signal.

2. The electric musical instrument of claim 1, comprising:

a fingerboard; and a nut;

wherein the plurality of strings extend from the nut to the bridge across at least a portion of the fingerboard and at least a portion of the body.

3. The electric musical instrument of claim 2, comprising a locking mechanism having a first operational state and a second operational state, in which in the first operational state the locking mechanism is configured to lock the resonant stack to suppress oscillations of the bridge, and in the second operational state the locking mechanism does not suppress the oscillations of the bridge.

4. The electric musical instrument of claim 3 in which the locking mechanism comprises a lever and at least one pin, the bridge defines at least one hole, the lever is configured to be movable between a first position and a second position, and the locking mechanism is configured such that moving the lever to the first position causes the at least one pin to engage the at least one hole to prevent oscillations of the bridge, and moving the lever to the second position causes the at least one pin to disengage from the at least one hole to allow the bridge to oscillate when excited by vibrations of the strings.

5. The electric musical instrument of claim 3 in which the locking mechanism comprises a window style locking mechanism having a lock wheel having a finger, the bridge has a slot, the lock wheel is rotatable between a first position and a second position and configured such that when the lock wheel rotates to the first position, the finger of the lock wheel engages the slot of the bridge and prevents oscillations of the bridge, and when the lock wheel rotates to the second position, the finger of the lock wheel disengages from the slot of the bridge to enable the bridge to oscillate when excited by vibrations of the strings.

6. The electric musical instrument of claim 1 in which the resonant stack comprises a second mass and a second spring having a second spring constant, and wherein the resonant stack has at least a first resonant frequency and a second resonant frequency that are dependent on the bridge mass, the first spring constant, the second mass, and the second spring constant.

7. The electric musical instrument of claim 6 in which a center of mass of the first spring is disposed between a center of mass of the bridge and a center of mass of the second mass, and a center of mass of the second spring is disposed between a center of mass of the second mass and the body of the electrical musical instrument.

8. The electric musical instrument of claim 6 in which the bridge is directly or indirectly coupled to the second mass through the first spring, and the second mass is directly or indirectly coupled to the body through the second spring.

9. The electric musical instrument of claim 6 in which the bridge, the first spring, and the second mass are configured such that when the bridge vibrates, at least a portion of the vibration of the bridge is transmitted to the second mass through the first spring.

10. The electric musical instrument of claim 1, comprising an electronic circuit configured to combine the first pickup signal with the second pickup signal to generate a combined output signal.

11. The electric musical instrument of claim 1, comprising:

an electronic circuit to process at least one of the first pickup signal or the second pickup signal; and a switch that is configured to select between a first mode and a second mode, in which when the first mode is selected, the electronic circuit is configured to combine the first pickup signal and the second pickup signal to generate a combined output signal that is provided to an output jack of the electric musical instrument, and when the second mode is selected, the electronic circuit is configured to provide the first pickup signal to the output jack.

12. The electric musical instrument of claim 11 in which the first pickup signal is configured to have sound characteristics that resemble those of a conventional electric guitar, and the mixed output signal is configured to have sound characteristics that more closely resemble those of a conventional acoustic guitar.

13. The electric musical instrument of claim 6 in which the first and second resonant frequencies are in a range between 40 Hz to 450 Hz.

14. The electric musical instrument of claim 2 in which a first portion of the bridge is pivotly coupled to the body, or pivotly coupled to a hinge coupled to the body, a second portion of the bridge is coupled to the first spring, and the nut and saddles coupled to the second portion of the bridge define the vibrating lengths of the strings.

15. The electric musical instrument of claim 6 in which the resonant stack further comprises a third mass and a third spring, the third spring has a third spring constant, the resonant stack has at least a first resonant frequency, a second resonant frequency, and a third resonant frequency that are dependent on the bridge mass, the first spring constant, the second mass, the second spring constant, the third mass, and the third spring constant.

16. The electric musical instrument of claim 15 in which the bridge, the first spring, the second mass, the third spring, and the third mass are configured such that when the bridge vibrates, at least a portion of the vibration of the bridge is transmitted to the second mass through the first spring, and when the second mass vibrates, at least a portion of the vibration of the second mass is transmitted to the third mass through the second spring.

17. The electric musical instrument of claim 15 in which the second mass is configured to clamp the first spring to the second spring, and the third mass is configured to clamp the second spring to the third spring.

18. The electric musical instrument of claim 15 in which the resonant stack is coupled to an upper surface of the body, and the bridge and the second mass primarily oscillate along directions substantially orthogonal to the upper surface of the body.

19. The electric musical instrument of claim 15 in which the bridge, the first spring, the second mass, the second spring, the third mass, and the third spring are configured such that each of the bridge, the second mass, and the third mass has a single degree of freedom.

20. The electric musical instrument of claim 1 in which the resonant stack comprises a first damping material applied to the first spring.

21. The electric musical instrument of claim 1 in which the first spring comprises a leaf-style spring having a first leaf member and a second leaf member, a first end of the first leaf member is attached to a first end of the second leaf member, a second end of the first leaf member is attached to a second end of the second leaf member, and a middle portion of the first leaf member is spaced apart from a middle portion of the second leaf member to form an opening between the first and second leaf members.

22. The electric musical instrument of claim 1, comprising a digital signal processor configured to process at least one of the first pickup signal or the second pickup signal by applying a selected frequency response curve to the pickup signal, in which the selected frequency response is selected from a plurality of pre-stored frequency response curves.

23. The electric musical instrument of claim 1 in which the electric musical instrument comprises at least one of an electric guitar, an electric bass guitar, an electric violin, an electric viola, an electric cello, an electric double bass, an electric banjo, an electric mandolin, or an electric ukulele.

24. A resonant bridge module for use in an electric musical instrument, the resonant bridge module comprising:

a bridge, at least a first spring, and a base plate, in which the base plate is configured to be attached to a body of the electric musical instrument, the bridge has a bridge mass, the first spring has a first spring constant, and the bridge mass and the first spring constant are selected such that the resonant bridge module has at least a first resonant frequency in a range from 40 Hz to 450 Hz;

wherein the bridge comprises components for receiving a plurality of strings that extend across at least a portion of a body of the electric musical instrument, in which each string has a vibrating length defined at least in part by the bridge.

25. A method comprising:

detecting, using at least a first pickup device, vibrations of strings that extend across at least a portion of a body of an electric musical instrument and generate a first pickup signal;

detecting, using at least a second pickup device, movements of a bridge plate of a resonant bridge and generate a second pickup signal, in which vibrating lengths of the strings are defined in part by the resonant bridge, and the resonant bridge has at least a first resonant frequency in a range from 40 Hz to 450 Hz; and combining the first pickup signal and the second pickup signal to generate a combined signal that is provided to an output jack of the electric musical instrument.

* * * * *